US009309084B2

(12) United States Patent
Ukai et al.

(10) Patent No.: US 9,309,084 B2
(45) Date of Patent: Apr. 12, 2016

(54) IMAGE FORMING APPARATUS HAVING METAL BRACKET ATTACHED TO FRAME

(71) Applicant: Brother Kogyo Kabushiki Kaisha, Nagoya (JP)

(72) Inventors: Masamitsu Ukai, Nagoya (JP); Saya Minoshima, Gifu (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/672,326

(22) Filed: Mar. 30, 2015

(65) Prior Publication Data

US 2015/0274478 A1 Oct. 1, 2015

(30) Foreign Application Priority Data

Mar. 31, 2014 (JP) ..... 2014-071635
Mar. 31, 2014 (JP) ..... 2014-072122

(51) Int. Cl.

| | |
|---|---|
| ***G03G 21/16*** | (2006.01) |
| ***G03G 15/00*** | (2006.01) |
| ***B65H 31/24*** | (2006.01) |
| ***B65H 29/58*** | (2006.01) |

(52) U.S. Cl.

CPC ..... *B65H 31/24* (2013.01); *B65H 29/58* (2013.01); *G03G 15/6552* (2013.01); *G03G 21/1619* (2013.01); *G03G 21/1642* (2013.01); *G03G 21/1647* (2013.01); *B65H 2401/11* (2013.01); *B65H 2401/15* (2013.01); *B65H 2402/60* (2013.01); *B65H 2408/111* (2013.01); *G03G 21/1666* (2013.01); *G03G 2221/1684* (2013.01)

(58) Field of Classification Search

CPC ..... G03G 21/1619; G03G 21/1642; G03G 21/1647; G03G 2221/1684

See application file for complete search history.

(56) References Cited

U.S. PATENT DOCUMENTS

| | | | | |
|---|---|---|---|---|
| 2004/0253031 | A1 | 12/2004 | Okazaki | |
| 2010/0149440 | A1* | 6/2010 | Yokawa | F16M 11/00 348/836 |
| 2011/0274463 | A1 | 11/2011 | Taguchi et al. | |

FOREIGN PATENT DOCUMENTS

| | | | |
|---|---|---|---|
| JP | 07-252015 | A | 10/1995 |
| JP | 2003-076090 | A | 3/2003 |
| JP | 2004-191499 | A | 7/2004 |
| JP | 2005/003782 | A | 1/2005 |
| JP | 2011/237579 | A | 11/2011 |

* cited by examiner

*Primary Examiner* — Rodney Bonnette
(74) *Attorney, Agent, or Firm* — Burr & Brown, PLLC

(57) ABSTRACT

An image forming apparatus including an image forming unit, a main body including a first discharge tray configured to receive a sheet conveyed out from the image forming unit, and a resin frame, the main body being configured to support a sheet discharge unit attached thereto, the sheet discharge unit including a second discharge tray configured to receive a sheet conveyed out of the main body through the image forming unit, and an insertion member, a metal bracket attached to the frame, the bracket having an opening into which the insertion member of the sheet discharge unit is inserted when the sheet discharge unit is attached to the main body.

25 Claims, 18 Drawing Sheets

IMAGE FORMING APPARATUS HAVING METAL BRACKET ATTACHED TO FRAME

CROSS-REFERENCE TO RELATED APPLICATION

This application claims priority under 35 U.S.C. §119 from Japanese Patent Applications No. 2014-072122 and No. 2014-071635, both filed on Mar. 31, 2014. The entire subject matters of the applications are incorporated herein by reference.

BACKGROUND

1. Technical Field

The following description relates to aspects of an image forming apparatus configured such that a sheet discharge unit is attachable to a main body of the apparatus.

2. Related Art

An image forming apparatus has been known of which a main body is formed by a resin frame. Further, in the image forming apparatus, a unit separate from the main body is put on the frame and is fixedly attached to the frame by screws.

SUMMARY

However, in the known image forming apparatus, since the frame is made of resin, a mechanical strength of a portion of the frame where the unit is firmly attached to the main body of the apparatus is insufficient.

Aspects of the present disclosure are advantageous to provide one or more improved techniques, for an image forming apparatus, which make it possible to enhance a mechanical strength of a portion of a resin frame where a unit is attached to a main body of the apparatus.

According to aspects of the present disclosure, an image forming apparatus is provided that includes an image forming unit, a main body including a first discharge tray configured to receive a sheet conveyed out from the image forming unit, and a resin frame, the main body being configured to support a sheet discharge unit attached thereto, the sheet discharge unit including a second discharge tray configured to receive a sheet conveyed out of the main body through the image forming unit, and an insertion member, a metal bracket attached to the frame, the bracket having an opening into which the insertion member of the sheet discharge unit is inserted when the sheet discharge unit is attached to the main body.

According to aspects of the present disclosure, further provided is an image forming apparatus that includes an image forming unit, a main body including a first discharge tray configured to receive a sheet conveyed out from the image forming unit, and a frame made of a first material, the main body being configured to support a sheet discharge unit attached thereto, the sheet discharge unit including a second discharge tray configured to receive a sheet conveyed out of the main body through the image forming unit, and an insertion member, a bracket attached to the frame, the bracket having an opening into which the insertion member is inserted when the sheet discharge unit is attached to the main body, the bracket being made of a second material having a higher stiffness than the first material of the frame.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
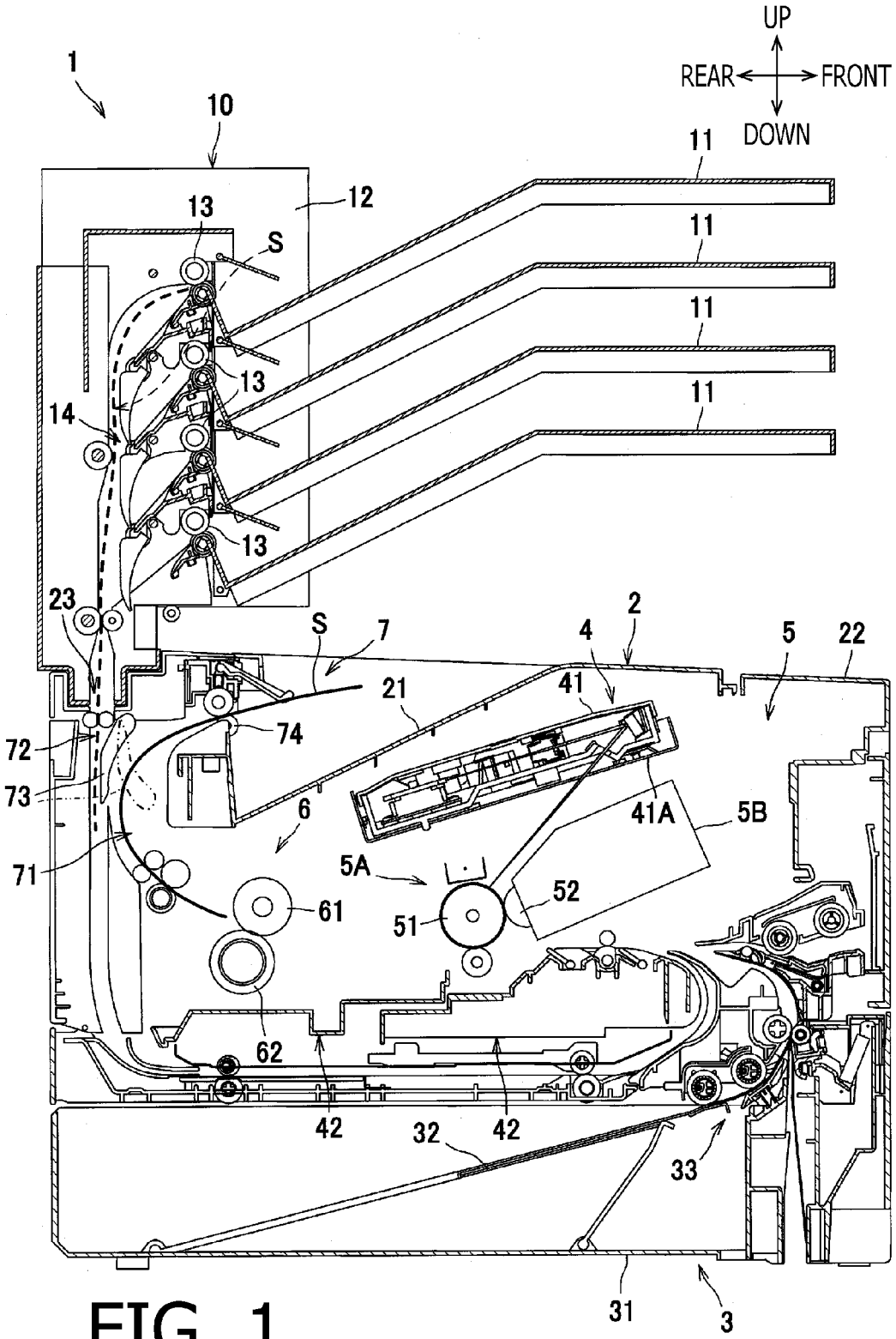
FIG. 1 is a cross-sectional side view schematically showing a configuration of a laser printer with a sheet discharge unit attached thereto in accordance with one or more aspects of the present disclosure.

Hereinafter, embodiments according to aspects of the present disclosure will be described with reference to the accompanying drawings. In the following description, each of front, rear, left, right, upper, and lower sides of a laser printer 1 will be defined as shown in FIG. 1. Specifically, a right side of FIG. 1 will be defined as the front side of the laser printer 1. A left side of FIG. 1 will be defined as the rear side of the laser printer 1. A near side with respect to a plane surface of FIG. 1 will be defined as the left side of the laser printer 1. A far side with respect to the plane surface of FIG. 1 will be defined as the right side of the laser printer 1. Further, upper and lower sides of FIG. 1 will be defined as the upside and the downside of the laser printer 1, respectively.

As shown in FIG. 1, the laser printer 1 includes a main body onto which a sheet discharge unit 10 is selectively attachable as an optional component.

The main body 2 includes therein a sheet feeder 3, an image forming unit 4, and a conveyor 7. The main body 2 includes a main-body discharge tray 21 disposed at an upper portion of the main body 2. The main-body discharge tray 21 is configured to support thereon one or more sheets S discharged by the conveyor 7.

The sheet feeder 3 is disposed at a lower portion inside the main body 2. The sheet feeder 3 includes a feed tray 31, a sheet pressing plate 32, and a feeder mechanism 33. The sheet pressing plate 32 is disposed at the feed tray 31. The feeder mechanism 33 includes a plurality of rollers.

In the sheet feeder 3, a sheet S placed on the feed tray 31 is lifted toward the feeder mechanism 33 by the sheet pressing plate 32, and is fed to the image forming unit 4 by the feeder mechanism 33.

The image forming unit 4 is disposed above the sheet feeder 3. The image forming unit 4 is configured to form an image on a sheet S fed by the sheet feeder 3. The image forming unit 4 includes an exposure unit 41, a process cartridge 5, and a fuser unit 6.

The exposure unit 41 is disposed at an upper portion inside the main body 2. The exposure unit 41 includes a laser emitter (not shown), a polygon mirror (shown without any reference characters), lenses (shown without any reference characters), and a reflecting mirror (shown without any reference characters). In the exposure unit 41, the laser emitter emits a laser beam based on image data, and the laser beam is scanned on a surface of a photoconductive drum 51 of the process cartridge 5 at a high speed. Thereby, the surface of the photoconductive drum 51 is exposed.

The process cartridge 5 is disposed below the exposure unit 41. The process cartridge 5 is detachably attached to the main body 2 via an attachment opening. The attachment opening is formed when a front cover 22 of the main body 2 is open. The process cartridge 5 includes a drum cartridge 5A and a development cartridge 5B.

The drum cartridge 5A includes a charger (shown without any reference characters) and a transfer roller (shown without any reference characters), as well as the photoconductive drum 51. Further, the development cartridge 5B is detachably attached to the drum cartridge 5A. The development cartridge 5B includes a development roller 52, a supply roller (shown without any reference characters), a layer thickness regulating blade (shown without any reference characters), and a toner container (shown without any reference characters) configured to store toner.

In the process cartridge 5, the surface of the photoconductive drum 51 is evenly charged by the charger. Thereafter, the surface of the photoconductive drum 51 is exposed to the rapidly scanned laser beam from the exposure unit 41. Thereby, an electrostatic latent image based on the image data is formed on the photoconductive drum 51. Further, toner stored in the toner container is supplied to the development roller 52 via the supply roller, and is introduced between the development roller 52 and the layer thickness regulating blade. Thus, the toner is carried on the development roller 52 as a thin layer with a constant thickness.

The toner carried on the development roller 52 is supplied from the development roller 52 to the electrostatic latent image formed on the photoconductive drum 51. Thereby, the electrostatic latent image is visualized, and a toner image is formed on the photoconductive drum 51. After that, when a sheet S is conveyed between the photoconductive drum 51 and the transfer roller, the toner image on the photoconductive drum 51 is transferred onto the sheet S.

The fuser unit 6 is disposed behind the process cartridge 5. The fuser unit 6 includes a heating unit 61 with a heat generator, and a pressing roller 62 configured to pinch a fuser belt between the heating unit 61 and the pressing roller 62. The fuser unit 6 is configured to thermally fix the toner image transferred on the sheet S when the sheet S is passing between the heating unit 61 and the pressing roller 62.

The conveyor 7 includes a main-body discharging path 71, a conveying-out path 72, a flapper 73, and a discharge roller 74. The main-body discharging path 71 is configured to convey the sheet S discharged from the fuser unit 6 onto the main-body discharge tray 21. The conveying-out path 72 diverges from the main-body discharging path 71. The flapper 73 is disposed at a branching portion where the conveying-out path 72 diverges from the main-body discharging path 71. The discharge roller 74 is disposed near an exit of the main-body discharging path 71.

The conveying-out path 72 is configured to convey the sheet S to the sheet discharge unit 10 via a communication port 23. The communication port 23 is formed at a rear portion of an upper surface of the main body 2.

The flapper 73 is supported by the main body 2 to be swingable back and forth. The flapper 73 is configured to guide, to the discharge roller 74, the sheet S being conveyed along the main-body discharging path 71 when swinging rearward to a position to shut the conveying-out path 72 (see a solid line in FIG. 1). Further, the flapper 73 is configured to guide, to the conveying-out path 72, the sheet S being conveyed along the main-body discharging path 71 when swinging frontward to a position to shut the main-body discharging path 71 (see an alternate long and short dash line in FIG. 1).

In the conveyor 7, when the flapper 73 swings rearward, the sheet S conveyed out from the image forming unit 4 is conveyed along the main-body discharging path 71 and is discharged onto the main-body discharge tray 21 by the discharge roller 74. Meanwhile, when the flapper 73 swings frontward, the sheet S conveyed out from the image forming unit 4 is guided from the main-body discharging path 71 to the conveying-out path 72 and is conveyed out to the sheet discharge unit 10 via the communication port 23.

The sheet discharge unit 10 includes a plurality of optional trays 11, a housing 12, a plurality of discharge rollers 13, and a sheet discharge unit path 14. The plurality of optional trays 11 are arranged in the vertical direction. The housing 12 is configured to support the plurality of optional trays 11. The plurality of discharge rollers 13 are provided in correspondence with the plurality of discharge rollers 13, respectively. The sheet discharge unit path 14 is configured to communicate with the conveying-out path 72 via the communication port 23 and to convey the sheet S carried through the conveying-out path 72 to one of the discharge rollers 13.

In the sheet discharge unit 10, the sheet S conveyed out from the communication port 23 of the main body 2 is guided by the sheet discharge unit path 14, and is discharged onto an intended one of the optional trays 11 via a corresponding discharge roller 13. Thus, the discharged sheet S is placed on the intended optional tray 11.

First Illustrative Embodiment

Figure 2:
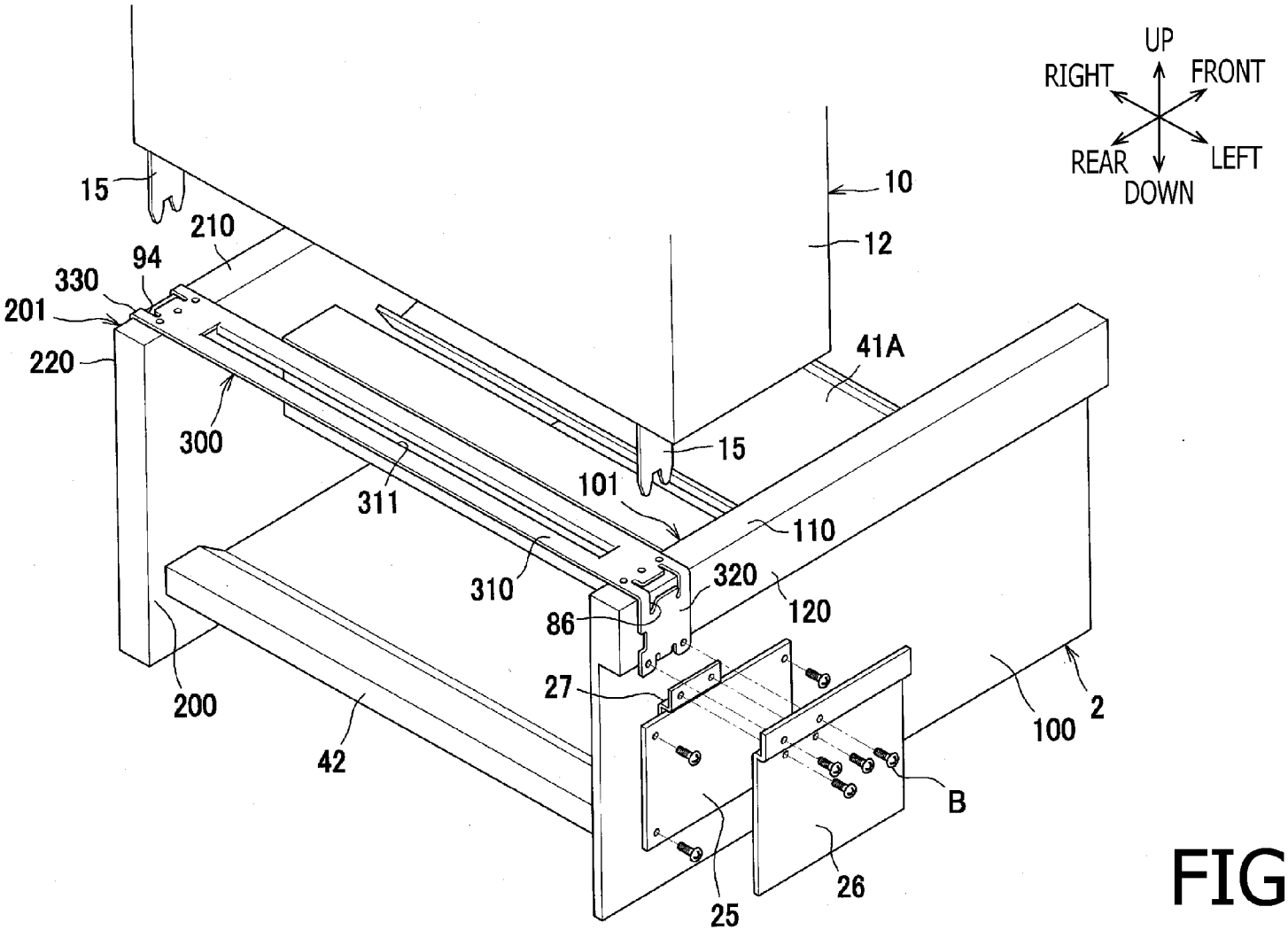
FIG. 2 is an exploded perspective view showing a main body and the sheet discharge unit in a first illustrative embodiment according to one or more aspects of the present disclosure.

Subsequently, a detailed explanation will be provided about a configuration for attaching the sheet discharge unit 10 to the main body 2 in a first illustrative embodiment. As shown in FIG. 2, the main body 2 includes two side frames 100 and 200, and a bracket 300 configured to bridge a distance between rear portions of the two side frames 100 and 200. The sheet discharge unit 10 includes two insertion members 15 that protrude from a lower surface of the housing 12. When the sheet discharge unit 10 is attached to the main body 2, the sheet discharge unit 10 is positioned at rear sections of the two side frames 100 and 200 with the insertion members 15 engaged with the bracket 300.

The two side frames 100 and 200 are made of resin. The two side frames 100 and 200 are disposed to face each other across the image forming unit 4 in the left-to-right direction.

The left side frame 100 supports, on an outer surface thereof in the left-to-right direction, a circuit board 25 and a cover member 26 configured to cover the circuit board 25. The cover member 26 is a plate-shaped metal member. An upper end portion of the cover member 26 is fixedly attached to the left side frame 100 by screws B. Between the circuit board 25 and the cover member 26, there is a metal member 27 configured to contact an earth member (not shown) provided to the circuit board 25 and contact the cover member 26. Thereby, the cover member 26 is electrically grounded via the circuit board 25.

The two side frames 100 and 200 are connected with each other via a conveyance guide 42 and a supporting plate 41A that are disposed between the two side frames 100 and 200. Further, the two side frames 100 and 200 are connected with each other via the bracket 300.

The conveyance guide 42 is made of resin. The conveyance guide 42 is configured to guide a downward-facing surface of a sheet S being conveyed through the image forming unit 4 (see FIG. 1). The supporting plate 41A is made of metal. The supporting plate 41A is configured to support the exposure unit 41 placed on an upper surface of the supporting plate 41A (see FIG. 1). The supporting plate 41A is disposed above a front portion of the conveyance guide 42, so as to overlap the conveyance guide 42 in a vertical view.

The bracket 300 is a metal plate member formed in a rectangular U-shape. The bracket 300 extends in the left-to-right direction (in which the two side frames 100 and 200 are opposed to each other), above the two side frames 100 and 200. The bracket 300 includes a first cover portion 310, a second cover portion 320, and a third cover portion 330. The first cover portion 310 extends up to an outside of each side frame 100 and 200 in the left-to-right direction. The second cover portion 320 extends downward from a left end portion of the first cover portion 310. The third cover portion 330 extends downward from a right end portion of the first cover portion 310.

The bracket 300 is disposed such that a left end portion and a right end portion of the bracket 300 cover a first placement portion 101 of the left side frame 100 and a second placement portion 201 of the right side frame 200, respectively. The first placement portion 101 and the second placement portion 201 are configured to support the sheet discharge unit 10 placed thereon.

The bracket 300 is disposed above a rear end portion of the conveyance guide 42, so as to overlap the conveyance guide 42 in a vertical view. Further, the bracket 300 is positioned rearward away from the supporting plate 41A in a vertical view. Since the bracket 300, the conveyance guide 42, and the supporting plate 41A for connecting the two side frames 100 and 200 are disposed in the aforementioned manner, it is possible to prevent torsion of the two side frames 100 and 200.

The bracket 300 has a through-hole 311 formed in a portion of the first cover portion 310 between the two side frames 100 and 200. The through-hole 311 has a longitudinal direction along the left-to-right direction. The through-hole 311 is configured such that a sheet S being carried along the conveying-out path 72 after passing through the image forming unit 4 is conveyed out to the sheet discharge unit 10 via the through-hole 311. Further, the bracket 300 is configured such that the sheet S passing through the through-hole 311 contacts an edge of the through-hole 311.

Figure 3:
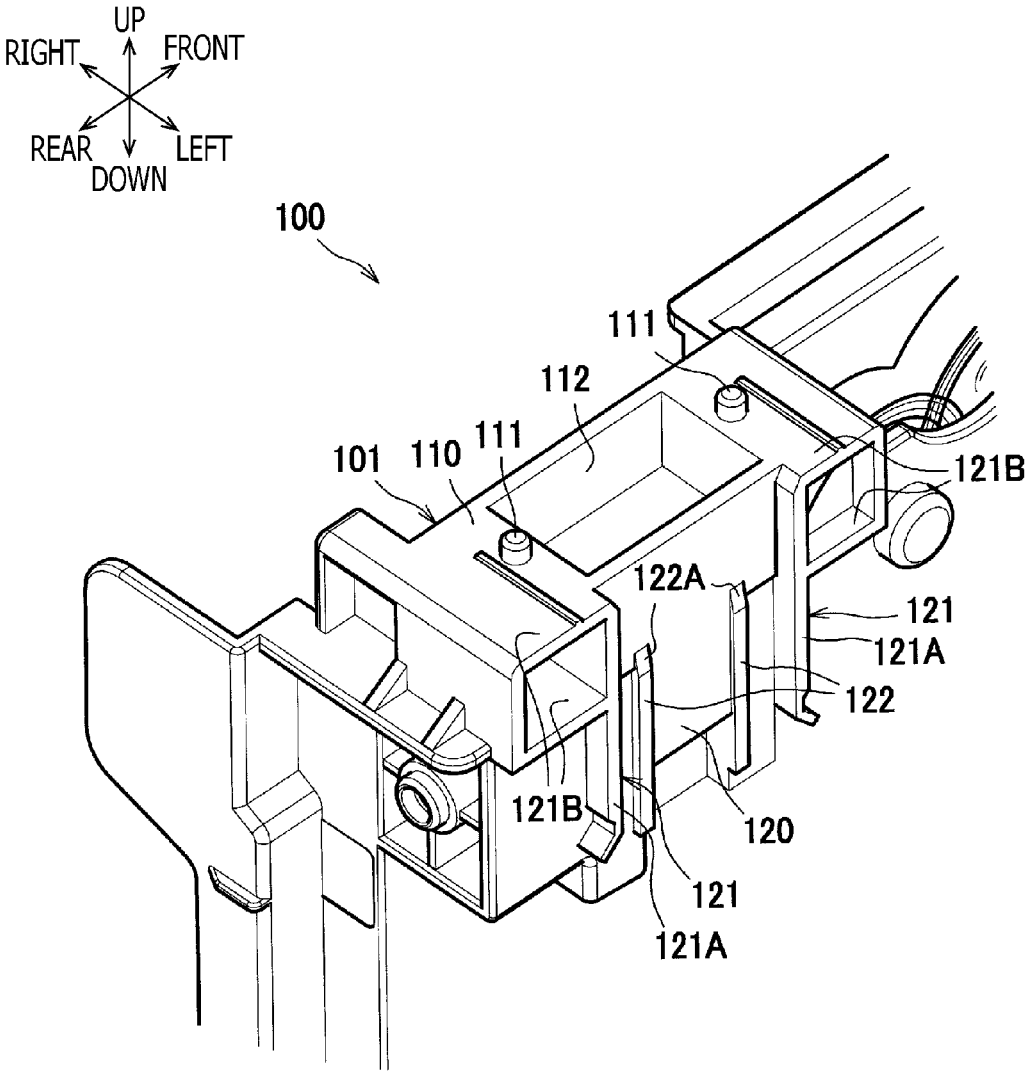
FIG. 3 is an enlarged perspective view showing a first placement portion at a rear end portion of a left side frame in the first illustrative embodiment according to one or more aspects of the present disclosure.

As shown in FIG. 3, the first placement portion 101 of the left side frame 100 has an upper surface 110 and a left side surface 120. The left side surface 120 extends downward from an outer end portion of the upper surface 110 in the left-to-right direction, i.e., a left end portion of the upper surface 110.

The upper surface 110 of the first placement portion 101 is configured to receive a load from the sheet discharge unit 10 when the sheet discharge unit 10 is attached to the main body 2. On the upper surface 110, two first positioning projections 111 are formed. The two first positioning projections 111 protrude upward from respective positions spaced apart from each other in the front-to-rear direction.

Further, between the two first positioning projections 111, there is a first recessed portion 112 that is recessed downward from the upper surface 110. As the first recessed portion 112 is formed in this manner, it is possible to prevent generation of so-called "Sink Marks" on the upper surface 110.

On the left side surface 120 of the first placement portion 101, there are two protrusions 121 and two ribs 122. The two protrusions 121 are arranged in the front-to-rear direction. The two ribs 122 are arranged between the two protrusions 121 in the front-to-rear direction.

Each protrusion 121 protrudes from the left side surface 120. Each protrusion 121 includes a rib-shaped first portion 121A and two rib-shaped second portions 121B. The first portion 121A longitudinally extends in the vertical direction. The two second portions 121B extend outward from an upper portion of the first portion 121A in the front-to-rear direction.

Each rib 122 protrudes from the left side surface 120. Each rib 122 longitudinally extends in the vertical direction. A protruding length of each rib 122 from the left side surface 120 is smaller than a protruding length of each protrusion 121 from the left side surface 120. In other words, a left end face of each protrusion 121 is positioned left of a left end face of each rib 122.

Further, each rib 122 has an inclined portion 122A formed at an upper end portion thereof. The inclined portion 122A extends downward and is inclined to be farther away from the left side surface 120 as going downward.

Figure 4:
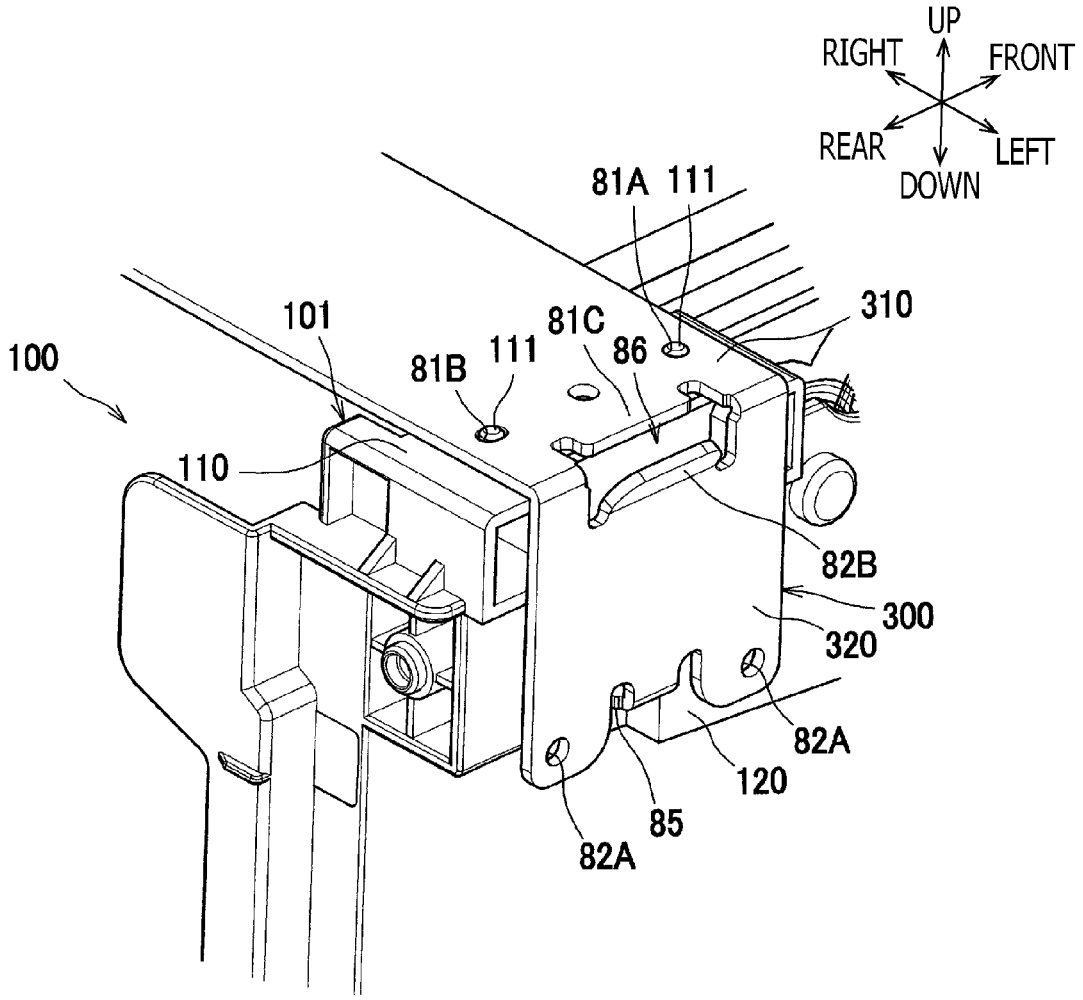
FIG. 4 is a perspective view showing the left side frame with a bracket attached thereto in the first illustrative embodiment according to one or more aspects of the present disclosure.
Figure 5:
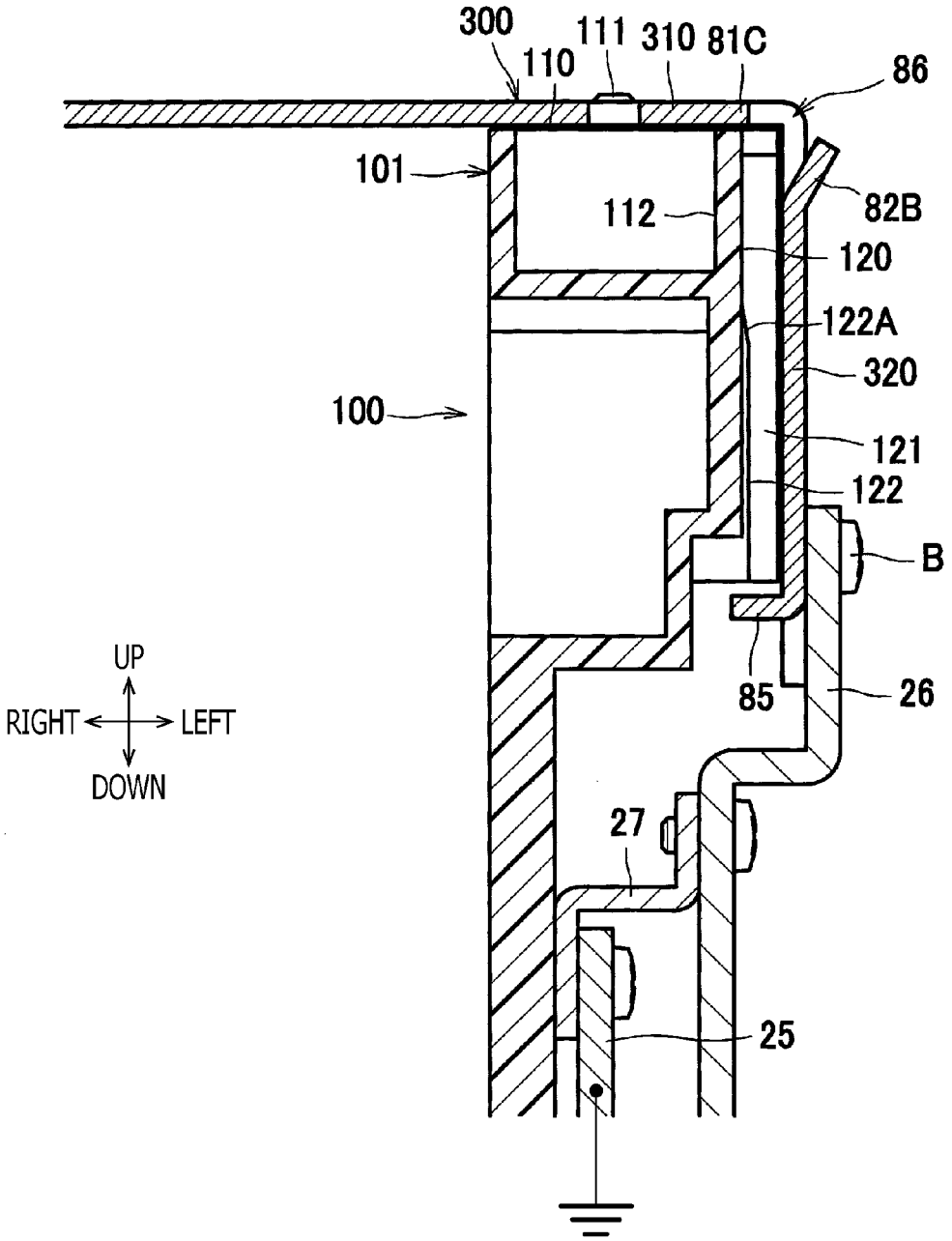
FIG. 5 is a cross-sectional rear view showing the left side frame with the bracket attached thereto in the first illustrative embodiment according to one or more aspects of the present disclosure.

As shown in FIGS. 4 and 5, the bracket 300 is disposed in such a position that a left end portion of the first cover portion 310 covers the upper surface 110 of the first placement portion 101. Further, the second cover portion 320 extends downward from the first cover portion 310, along the left side surface 120 of the first placement portion 101.

As shown in FIG. 4, in a left end portion of the first cover portion 310, a round hole 81A and a long hole 81B are formed. The long hole 81B is disposed behind the round hole 81A. The long hole 81B longitudinally extends in the front-to-rear direction. The round hole 81A and the long hole 81B are engaged with the two first positioning projections 111 formed on the upper surface 110 of the first placement portion 101, respectively. Thereby, the bracket 300 is positioned relative to the first placement portion 101 of the left side frame 100.

The second cover portion 320 includes a first engagement portion 85 formed at a middle section, in the front-to-rear direction, of a lower end portion of the second cover portion 320. The first engagement portion 85 protrudes rightward, i.e., toward the left side surface 120 of the first placement portion 101. Further, the second cover portion 320 includes two through-holes 82A formed in respective positions that are opposed to each other across the first engagement portion 85 in the front-to-rear direction.

As shown in FIG. 5, the second cover portion 320 contacts the two protrusions 121 formed on the left side surface 120 of the first placement portion 101. Thereby, the second cover portion 320 is spaced apart from the left side surface 120 of the first placement portion 101.

The lower end portion of the second cover portion 320 is positioned between the left side surface 120 of the first placement portion 101 and the cover member 26 in the left-to-right direction. When the screws B are screwed into the left side frame 100 through the cover member 26 and the two through-holes 82A of the second cover portion 320, the bracket 300, together with the cover member 26, is fixedly attached to the left side frame 100 (the left side surface 120). Further, as the bracket 300 is in contact with the cover member 26, the bracket 300 is electrically connected with the cover member 26, and is electrically grounded via the cover member 26.

As shown in FIGS. 4 and 5, at a corner portion between the first cover portion 310 and the second cover portion 320, a first opening 86 is formed. The first opening 86 is formed in such a shape that a left end portion of the first cover portion 310 and an upper end portion of the second cover portion 320 are cut out.

As shown in FIG. 5, there are a protecting portion 81C and a guide portion 82B formed in respective positions around the first opening 86.

The protecting portion 81C is formed at an edge portion, facing the first opening 86, of the first cover portion 310 and protrudes toward the second cover portion 320 in the left-to-right direction. Specifically, the protecting portion 81C protrudes toward the second cover portion 320 in the left-to-right direction even relative to the left side surface 120 of the first placement portion 101. Thereby, it is possible to prevent a distal end portion of the insertion member 15 of the sheet discharge unit 10 from coming into contact with the left side frame 100 made of resin when the insertion member 15 is inserted into the first opening 86.

Further, a protruding length of the protecting portion 81C from an extension plane of the left side surface 120 is identical to the protruding length of each rib 122 from the left side surface 120.

The guide portion 82B is formed at an edge portion, facing the first opening 86, of the second cover portion 320 and extends toward an outside of the first opening 86 (more specifically, obliquely toward an upper left side). In other words, the guide portion 82B extends in an obliquely upward direction to become farther away from the left side surface 120 of the first placement portion 101, from the edge portion, facing the opening 86, of the second cover portion 320.

Figure 6:
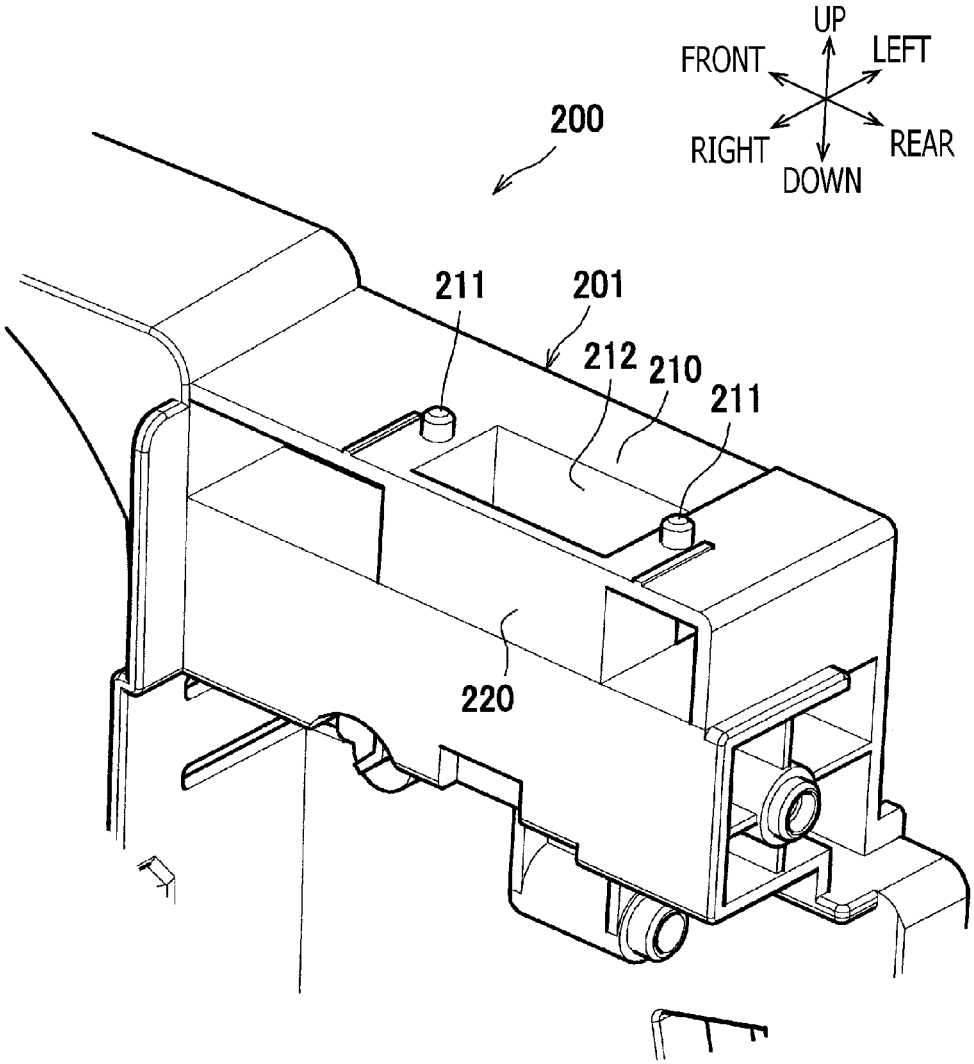
FIG. 6 is an enlarged perspective view showing a second placement portion at a rear end portion of a right side frame in the first illustrative embodiment according to one or more aspects of the present disclosure.

As shown in FIG. 6, the second placement portion 201 of the right side frame 200 includes an upper surface 210 and a right side surface 220. The right side surface 220 extends downward from a right end portion of the upper surface 210 (i.e., an outer end portion of the upper surface 210 in the left-to-right direction).

The upper surface 210 of the second placement portion 201 is configured to receive a load from the sheet discharge unit 10 when the sheet discharge unit 10 is attached to the main body 2. On the upper surface 210, two second positioning projections 211 are formed. The two second positioning projections 211 protrude upward from respective positions spaced apart from each other in the front-to-rear direction.

Further, between the two second positioning projections 211, there is a second recessed portion 212 that is recessed downward from the upper surface 210. In the same manner as the first recessed portion 112 formed at the left side frame 100, the second recessed portion 212 is formed to prevent generation of so-called "Sink Marks" on the upper surface 210.

Figure 7:
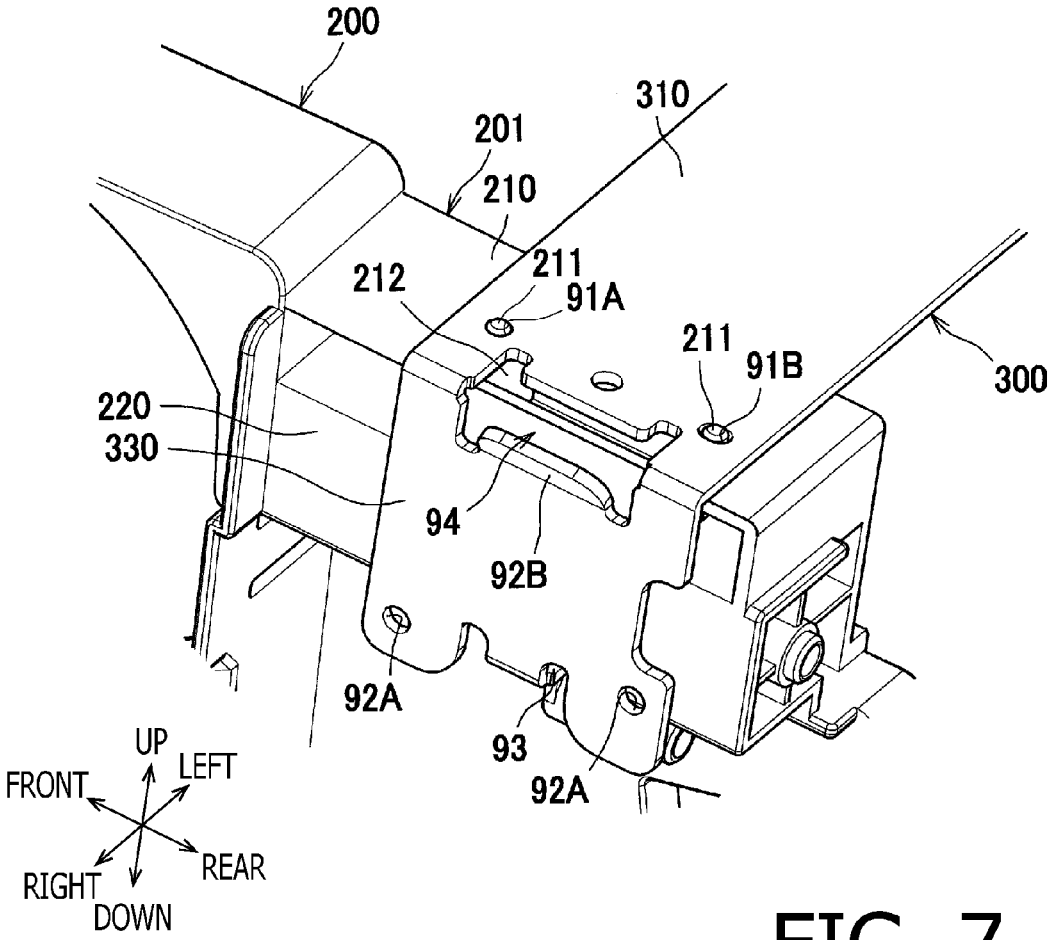
FIG. 7 is a perspective view showing the right side frame with the bracket attached thereto in the first illustrative embodiment according to one or more aspects of the present disclosure.
Figure 8:
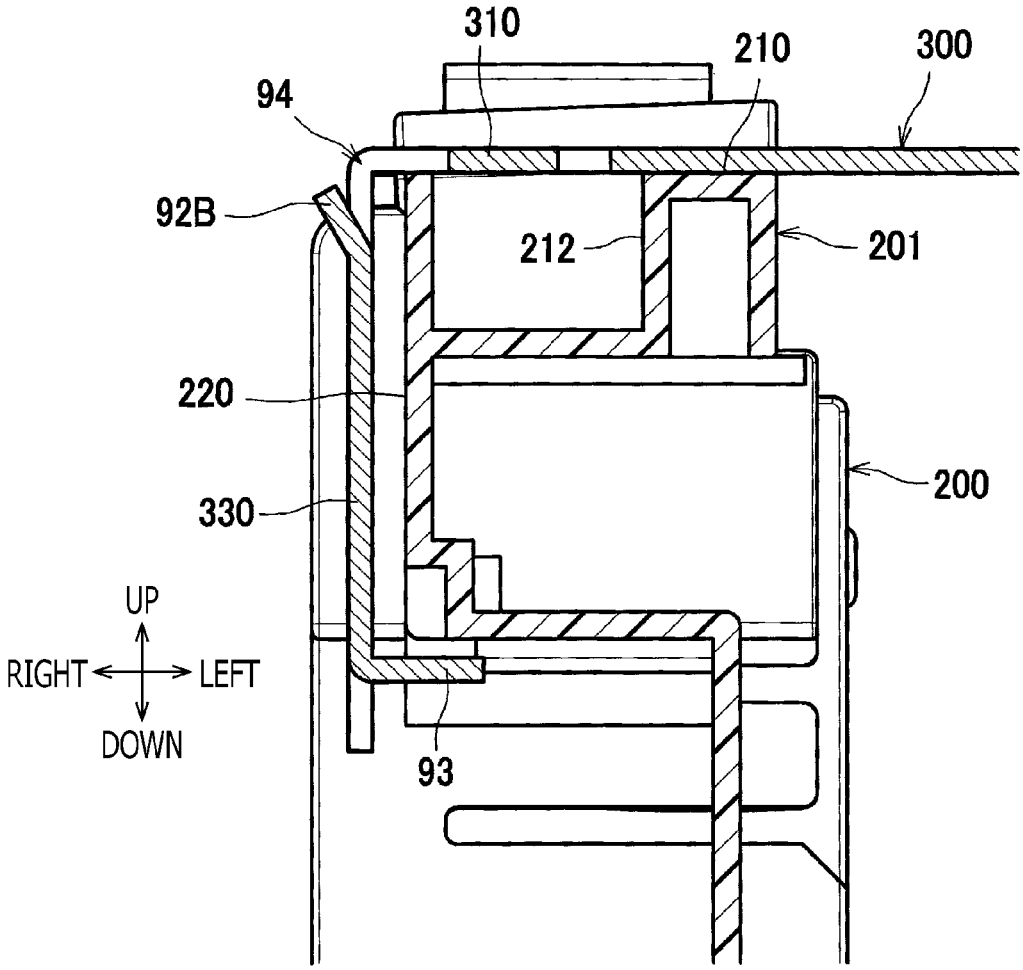
FIG. 8 is a cross-sectional rear view showing the right side frame with the bracket attached thereto in the first illustrative embodiment according to one or more aspects of the present disclosure.

As shown in FIGS. 7 and 8, a right end portion of the first cover portion 310 of the bracket 300 overlaps the upper surface 210 of the second placement portion 201 in a vertical view. Further, the third cover portion 330 of the bracket 300 extends downward from the first cover portion 310, along the right side surface 220 of the second placement portion 201. Thereby, the third cover portion 330 of the bracket 300 covers the right side surface 220.

As shown in FIG. 7, at the right end portion of the first cover portion 310, a round hole 91A and a long hole 91B are formed. The long hole 91B is disposed behind the round hole 91A. The long hole 91B longitudinally extends in the front-to-rear direction. The round hole 91A and the long hole 91B are engaged with the two second positioning projections 211 formed on the upper surface 210 of the second placement portion 201, respectively. Thereby, the bracket 300 is positioned with respect to the second placement portion 201 of the right side frame 200.

The third cover portion 330 includes a second engagement portion 93 formed at a middle section, in the front-to-rear direction, of a lower end portion of the third cover portion 330. The second engagement portion 93 protrudes leftward, i.e., toward the right side surface 220 of the second placement portion 201. Further, the third cover portion 330 includes two through-holes 92A formed in respective positions that are opposed to each other across the second engagement portion 93 in the front-to-rear direction.

The third cover portion 330 is spaced apart from the right side surface 220 of the second placement portion 201. When screws (not shown) are screwed into the right side frame 200 through the two through-holes 92A formed in the third cover portion 330, the bracket 300 is fixedly attached to the right side frame 200 (the right side surface 220).

At a corner portion between the first cover portion 310 and the third cover portion 330, a second opening 94 is formed. The second opening 94 is formed as a right end portion of the first cover portion 310 and an upper end portion of the third cover portion 330 are cut out. The second opening 94 is larger in the left-to-right direction than the first opening 86 formed in the left end portion of the bracket 300.

There is a guide portion 92B formed at an edge portion, facing the second opening 94, of the third cover portion 330. The guide portion 92B extends toward an outside of the second opening 94 (more specifically, obliquely toward an upper right side). In other words, the guide portion 92B extends in an obliquely upward direction to become farther away from the right side surface 220 of the second placement portion 201, from the edge portion, facing the second opening 94, of the third cover portion 330.

Figure 9:
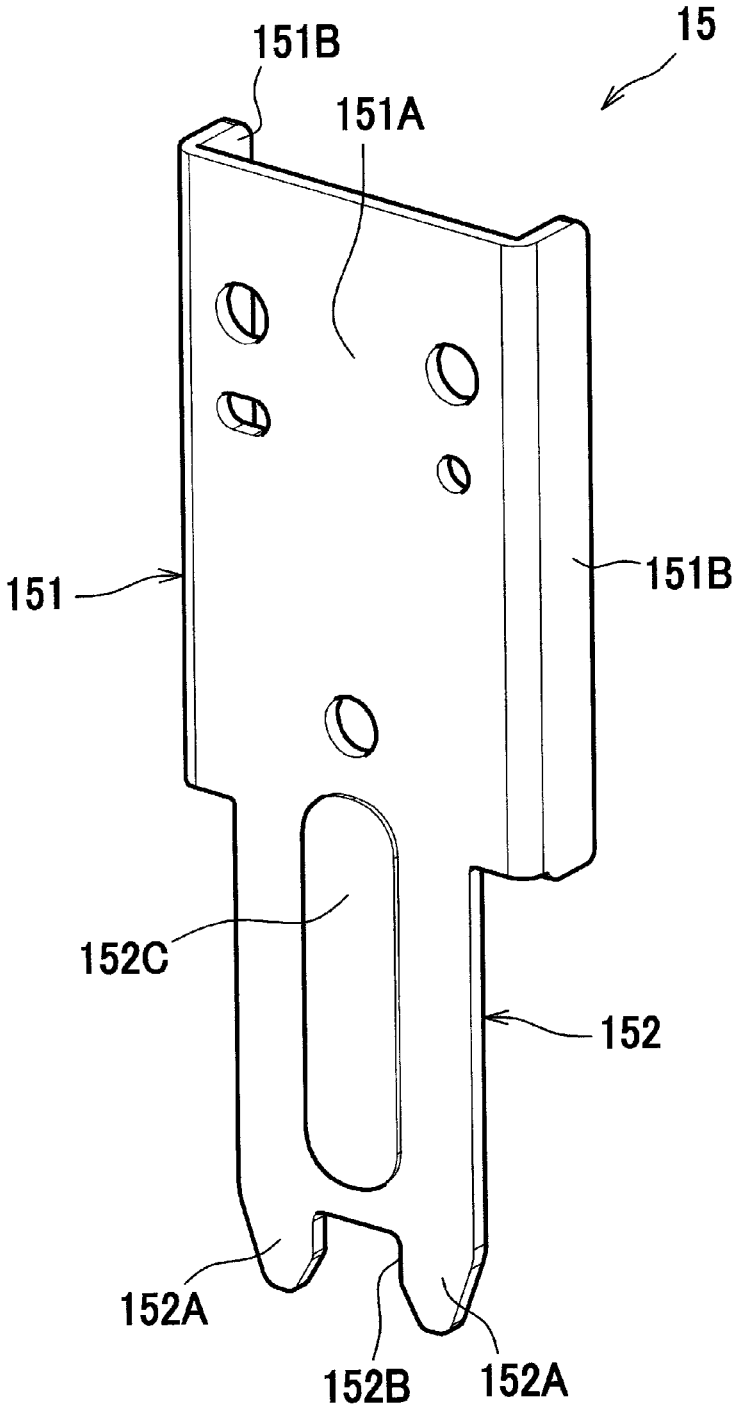
FIG. 9 is a perspective view showing an insertion member in accordance with one or more aspects of the present disclosure.

As shown in FIG. 9, each of the insertion members 15 of the sheet discharge unit 10 is a plate-shaped metal member. Each insertion member 15 includes an attachment portion 151 and an insertion portion 152. The attachment portion 151 is configured to be fixedly attached to the housing 12 of the sheet discharge unit 10. The insertion portion 152 extends downward from the attachment portion 151.

Figure 10A:
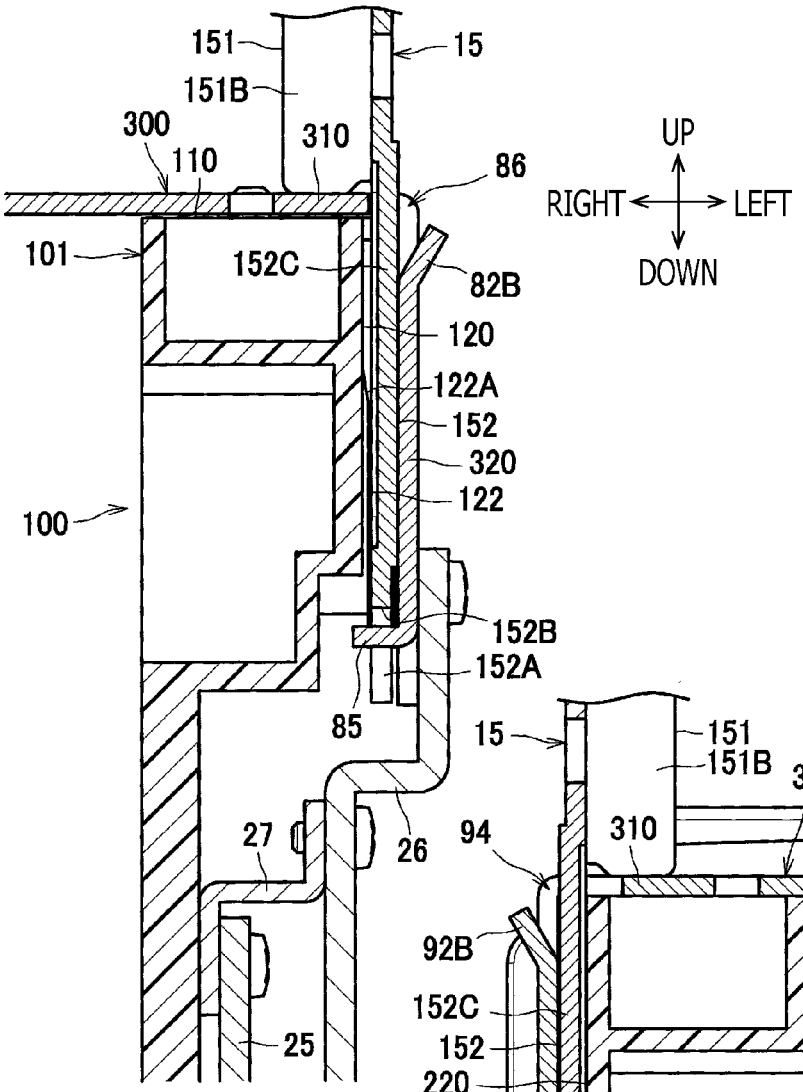
FIG. 10A is a cross-sectional rear view showing the left side frame and the bracket with the insertion member inserted thereinto in the first illustrative embodiment according to one or more aspects of the present disclosure.
Figure 10B:
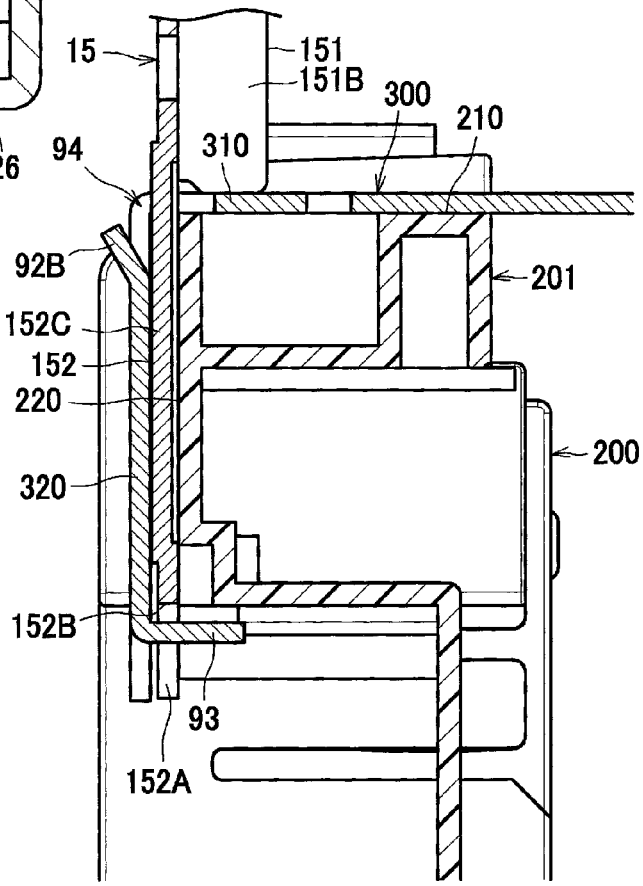
FIG. 10B is a cross-sectional rear view showing the right side frame and the bracket with another insertion member inserted thereinto in the first illustrative embodiment according to one or more aspects of the present disclosure.

The attachment portion 151 is formed in such a rectangular U-shape that a front end portion and a rear end portion of the attachment portion 151 are bent inward in the left-to-right direction, in a vertical view (see FIGS. 9, 10A, and 10B). Specifically, the attachment portion 151 includes a main body section 151A and contact sections 151B. The contact sections 151B extend inward in the left-to-right direction from a front end portion and a rear end portion of the main body section 151A, respectively.

The insertion portion 152 has a bifurcated distal end portion. Namely, the insertion portion 152 includes engagement protrusions 152A and an engagement recessed section 152B. Each engagement protrusion 152A protrudes downward. The engagement recessed section 152B is recessed upward at a central section of the distal end portion of the insertion portion 152 in the front-to-rear direction. Further, the insertion portion 152 includes a reinforcing portion 152C. The reinforcing portion 152C is formed in such a manner that a substantially central region of the insertion portion 152 is recessed inward in the left-to-right direction by drawing.

According to the insertion members 15 configured as above, as shown in FIGS. 10A and 10B, when the sheet discharge unit 10 is attached to the main body 2, the insertion portions 152 are inserted into the first opening 86 and the second opening 94 of the bracket 300, respectively. Further, the contact sections 151B of each attachment portion 151 (of the sheet discharge unit 10) are placed on a part of the bracket 300 that overlaps a corresponding one of the side frames 100 and 200 in a vertical view. Namely, the contact sections 151B of the left attachment portion 151 are placed on a part of the first cover portion 310 that overlaps the upper surface 110 of the first placement portion 101 in a vertical view. In addition, the contact sections 151B of the right attachment portion 151 are placed on a part of the first cover portion 310 that overlaps the upper surface 210 of the second placement portion 201 in a vertical view.

At the edge portion, facing the first opening 86, of the second cover portion 320, the guide portion 82B is formed. Further, at the edge portion, facing the second opening 94, of the third cover portion 330, the guide portion 92B is formed. By the guide portions 82B and 92B, the insertion portions 152 are guided to be inserted into the first opening 86 and the second opening 94, respectively. Thereby, it is possible to easily insert the insertion portions 152 into the first opening 86 and the second opening 94.

As shown in FIG. 10A, the inclined portion 122A is formed at the upper end portion of each of the ribs 122 that protrude from the left side surface 120 of the first placement portion 101. The inclined portion 122A is inclined to be closer to the second cover portion 320 as going downward to be farther away from the first opening 86. Therefore, it is possible to prevent the distal end portion of the insertion portion 152 inserted through the first opening 86 from being stuck on upper end portions of the ribs 122.

Further, each rib 122 protrudes toward the second cover portion 320 from the left side surface 120 of the first placement portion 101. Nonetheless, each rib 122 extends in the vertical direction (i.e., the direction in which the insertion portion 152 is inserted). Therefore, the insertion portion 152 is allowed to be inserted without being stuck on the ribs 122.

Then, the left insertion portion 152 inserted into the first opening 86 of the bracket 300 is disposed between the second cover portion 320 of the bracket 300 and the left side surface 120 of the first placement portion 101. Further, the left insertion portion 152 is sandwiched between the second cover portion 320 and the two ribs 122 of the left side surface 120. Specifically, the reinforcing portion 152C of the insertion portion 152 contacts the second cover portion 320. In addition, a part, other than the reinforcing portion 152C, of the insertion portion 152 contacts the two ribs 122.

Further, the first engagement portion 85 is inserted into the engagement recessed section 152B of the left insertion member 15. Then, the two engagement protrusions 152A engage with the first engagement portion 85 from the front and rear. Thereby, the left insertion member 15 is positioned relative to the bracket 300 in the front-to-rear direction (i.e., a direction perpendicular to the direction in which the second cover portion 320 and the left side surface 120 of the first placement portion 101 face each other).

As shown in FIG. 10B, the right insertion portion 152 inserted into the second opening 94 of the bracket 300 is disposed between the third cover portion 330 of the bracket 300 and the right side surface 220 of the second placement portion 201. Further, the second engagement portion 93 of the bracket 300 is inserted into the engagement recessed section 152B of the right insertion member 15. Then, the two engagement protrusions 152A come into engagement with the second engagement portion 93 from the front and rear. Thereby, the right insertion member 15 is positioned relative to the bracket 300 in the front-to-rear direction (i.e., a direction perpendicular to the direction in which the third cover portion 330 and the right side surface 220 of the second placement portion 201 face each other).

In the laser printer 1 configured as above in the first illustrative embodiment, the part (i.e., the bracket 300) of the main body 2 that is engaged with the insertion members 15 of the sheet discharge unit 10 is made of metal that is a material having a higher stiffness than resin. Therefore, it is possible to enhance the strength of parts, to which the sheet discharge unit 10 is fixedly attached, of the main body 2 including the side frames 100 and 200 made of resin.

Further, the bracket 300 connects the two side frames 100 and 200. Therefore, it is possible to enhance the strength of the main body 2 while avoiding an increase in the number of components.

The contact sections 151B of the insertion members 15 of the sheet discharge unit 10 are placed on the first cover portion 310 of the bracket 300. Nonetheless, the contact sections 151B are placed on parts of the first cover portion 310 that overlap the side frames 100 and 200 in a vertical view, respectively. Further, under the parts of the first cover portion 310 on which the contact sections 151B are positioned, the upper surface 110 of the first placement portion 101 and the upper surface 210 of the second placement portion 201 are disposed. Therefore, it is possible to receive, by wide surfaces of the first and second placement portions 101 and 201, loads applied onto the first cover portion 310 via the insertion members 15.

Further, the second opening 94 formed at the right end portion of the bracket 300 is larger in the left-to-right direction than the first opening 86 formed at the left end portion of the bracket 300. Hence, it is possible to absorb positional and/or dimensional errors of the two insertion members 15.

Further, the bracket 300 has the through-hole 311 through which the sheet S having passed through the image forming unit 4 is conveyed out toward the sheet discharge unit 10. Therefore, it is possible to make the main body 2 smaller in size than when the bracket 300 is disposed in a position displaced from a conveyance path along which the sheet S is conveyed.

Further, the bracket 300 is disposed such that the sheet S passing through the through-hole 311 contacts an edge of the through-hole 311. Furthermore, the bracket 300 is electrically grounded. Thus, it is possible to eliminate electricity charged on the sheet S that has passed through the image forming unit 4 by the bracket 300.

In the aforementioned first illustrative embodiment, the second cover portion 320 of the bracket 300 extends downward along the left side surface 120 from the first cover portion 310, so as to cover the left side surface 120 that is an outer side surface of the first placement portion 101 (the left side frame 100) in the left-to-right direction. Nonetheless, for instance, the second cover portion 320 may extend downward along a right inner side surface from the first cover portion 310, so as to cover the right inner side surface that is an inner side surface of the first placement portion 101 in the left-to-right direction.

Further, in the aforementioned first illustrative embodiment, the third cover portion 330 of the bracket 300 extends downward along the right side surface 220 from the first cover portion 310, so as to cover the right side surface 220 that is an outer side surface of the second placement portion 201 (the right side frame 100) in the left-to-right direction. Nonetheless, for instance, the third cover portion 330 may extend downward along a left inner side surface from the first cover portion 310, so as to cover the left inner side surface that is an inner side surface of the second placement portion 201 in the left-to-right direction.

Second Illustrative Embodiment

Subsequently, a detailed explanation will be provided about a configuration for attaching a sheet discharge unit 10 to a main body 2 in a second illustrative embodiment. It is noted that, in the second illustrative embodiment, elements having substantially the same configurations and/or functions as exemplified in the first illustrative embodiment will be provided with the same reference characters, and the elements may not be described in detail.

Figure 11:
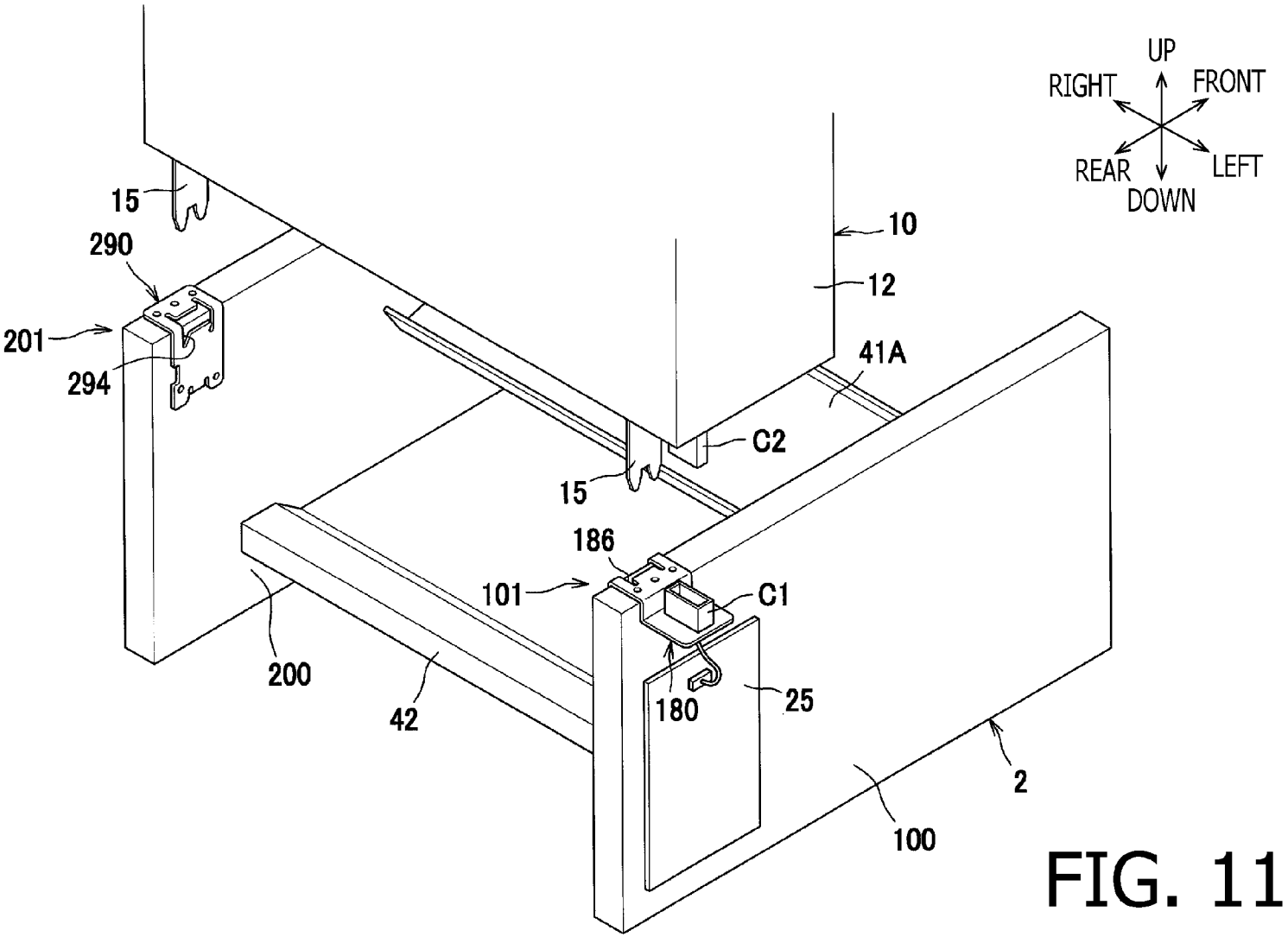
FIG. 11 is a perspective view showing two side frames, a first bracket, a second bracket, and a sheet discharge unit in a second illustrative embodiment according to one or more aspects of the present disclosure.

As shown in FIG. 11, the main body 2 includes two side frames 100 and 200. At rear end portions of the two side frames 100 and 200, the sheet discharge unit 10 is placed.

The two side frames 100 and 200 are made of resin. The two side frames 100 and 200 face each other across the image forming unit 4 in the left-to-right direction. The two side frames 100 and 200 are connected with each other via components (such as a conveyance guide 42 and a supporting plate 41A) disposed therebetween. The conveyance guide 42 is configured to define a conveyance path of the image forming unit 4. The supporting plate 41A is configured to support the exposure unit 41.

The left side frame 100 includes a first placement portion 101 as an upper rear end portion of the left side frame 100. A first bracket 180 is attached to the first placement portion 101. The right side frame 200 includes a second placement portion 201 as an upper rear end portion of the right side frame 200. A second bracket 90 is attached to the second placement portion 201. In addition, the first bracket 180 has a main-body connector C1 attached thereto. The main-body connector C1 is connected with a circuit board 25 attached to the main body 2.

The sheet discharge unit 10 includes two insertion members 15 and a discharge-unit connector C2. The two insertion members 15 protrude from a lower surface of a housing 12, and are configured to engage with the first bracket 180 and the second bracket 90, respectively. The discharge-unit connector C2 is configured to connect with the main-body connector C1.

Figure 12:
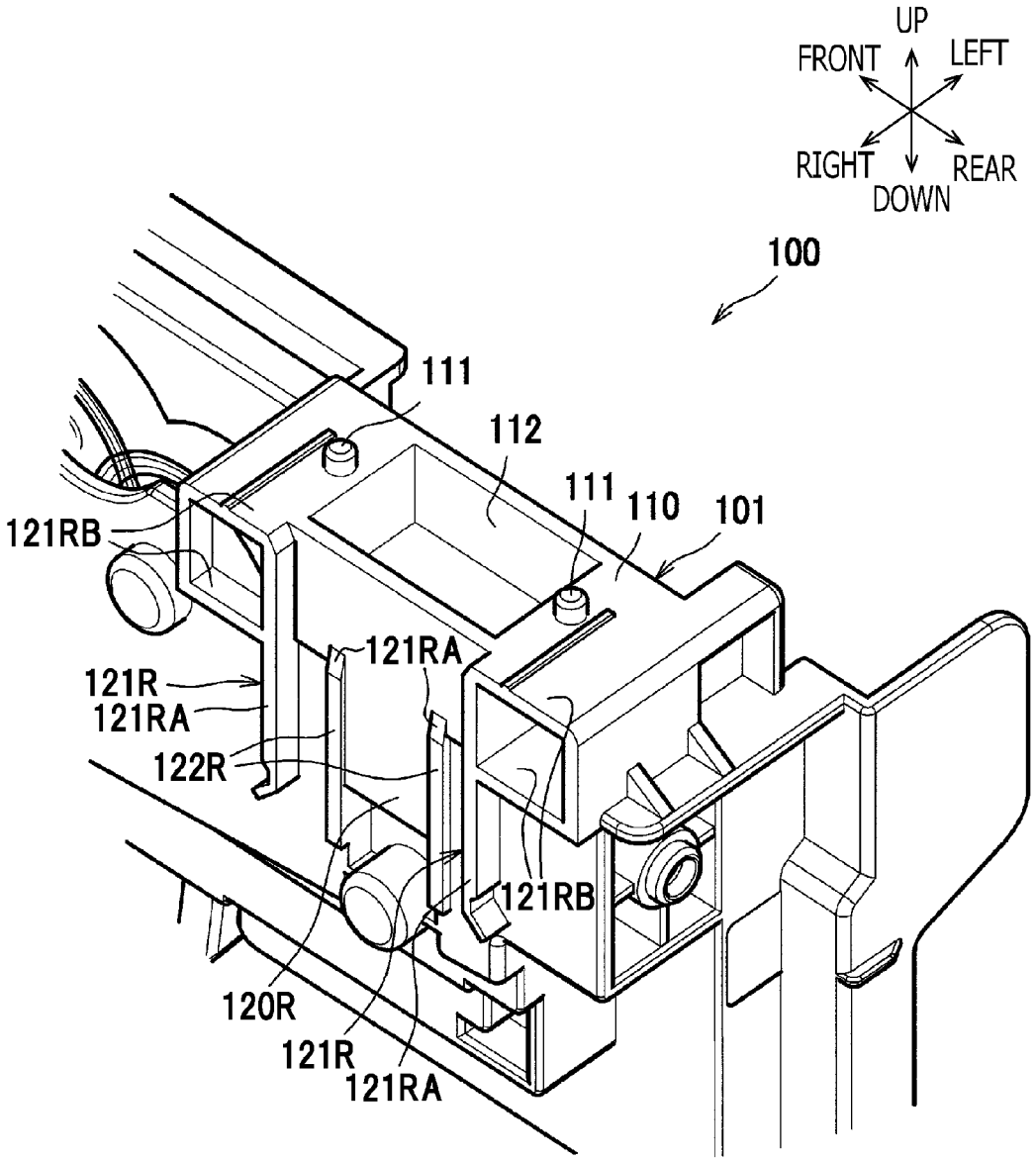
FIG. 12 is an enlarged perspective view showing a first placement portion at a rear end portion of a left side frame in the second illustrative embodiment according to one or more aspects of the present disclosure.
Figure 14A:
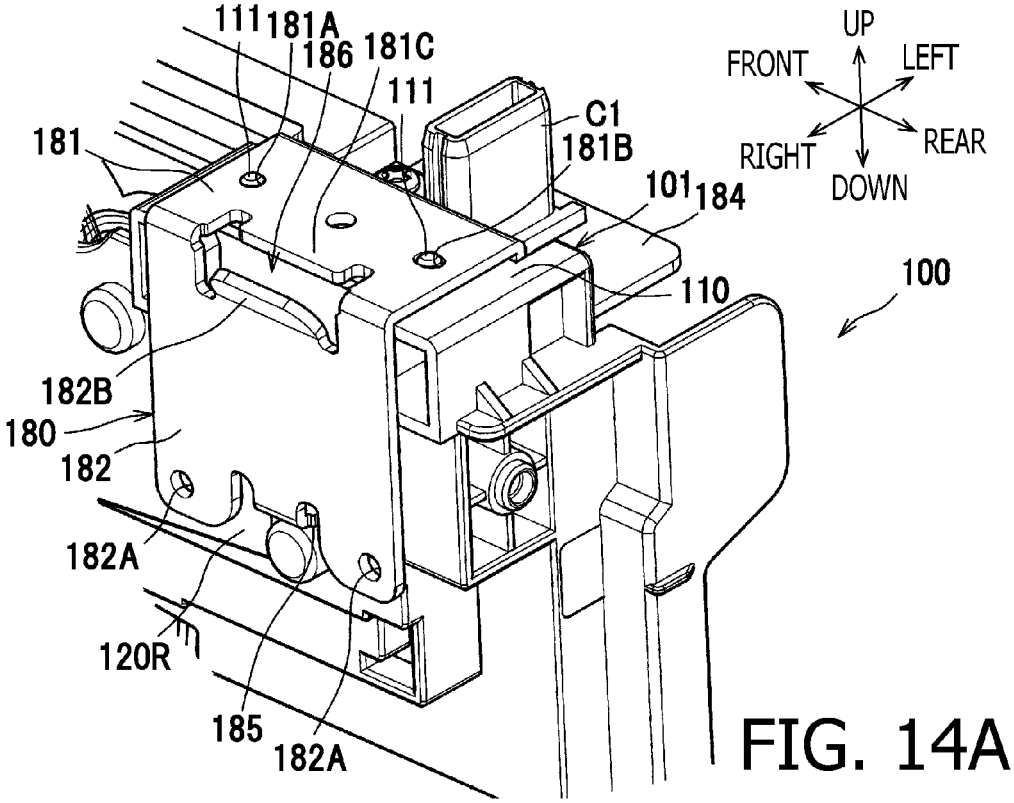
FIG. 14A is a perspective view showing the left side frame with the first bracket attached thereto in the second illustrative embodiment according to one or more aspects of the present disclosure.
Figure 14B:
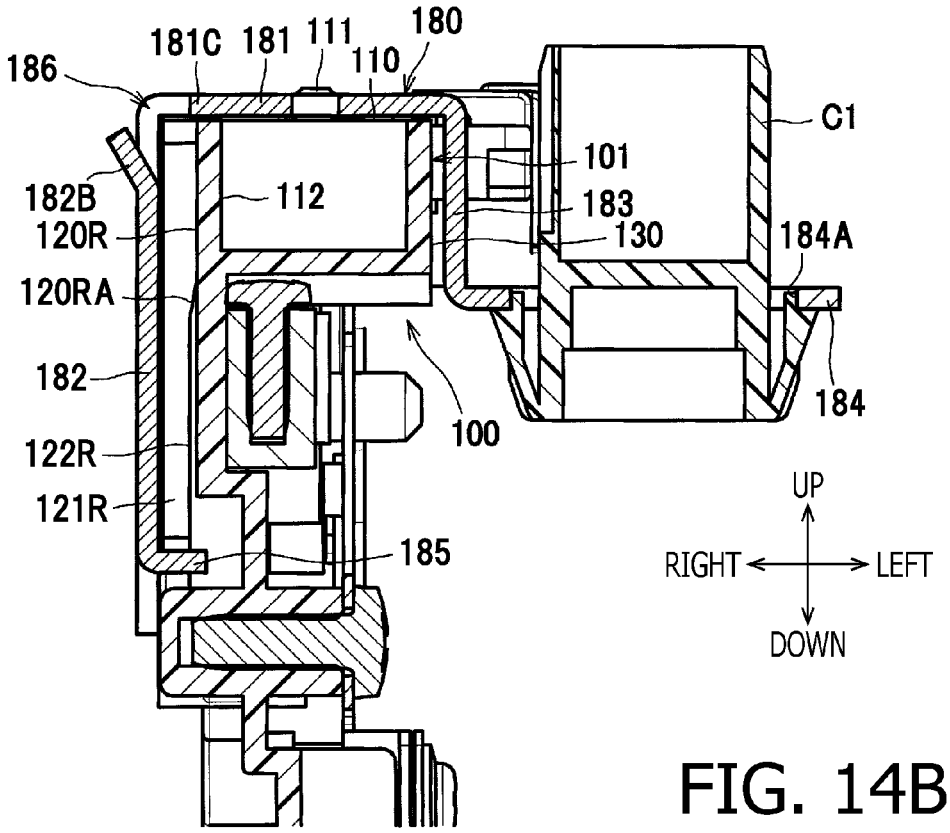
FIG. 14B is a cross-sectional rear view showing the left side frame with the first bracket attached thereto in the second illustrative embodiment according to one or more aspects of the present disclosure.

As shown in FIG. 12, the first placement portion 101 of the left side frame 100 has an upper surface 110, a right side surface 120R, and a left side surface 130 (see FIG. 14B). The right side surface 120R extends downward from a right end portion of the upper surface 110. The left side surface 130 extends downward from a left end portion of the upper surface 110.

The upper surface 110 of the first placement portion 101 is configured to receive a load from the sheet discharge unit 10 when the sheet discharge unit 10 is attached to the main body 2. On the upper surface 110, two first positioning projections 111 are formed. The two first positioning projections 111 protrude upward from respective positions spaced apart from each other in the front-to-rear direction.

Further, between the two first positioning projections 111, a first recessed portion 112 is formed to be recessed downward from the upper surface 110. As the first recessed portion 112 is formed in this manner, it is possible to prevent generation of so-called "Sink Marks" on the upper surface 110.

On the right side surface 120R of the first placement portion 101, there are two protrusions 121R and two ribs 122R. The two protrusions 121R are arranged in the front-to-rear direction. The two ribs 122R are arranged between the two protrusions 121R in the front-to-rear direction.

Each protrusion 121R protrudes from the right side surface 120R. Each protrusion 121R includes a rib-shaped first portion 121RA and two rib-shaped second portions 121RB. The first portion 121RA longitudinally extends in the vertical direction. The two second portions 121RB extend outward from an upper portion of the first portion 121RA in the front-to-rear direction.

Each rib 122R protrudes from the right side surface 120R. Each rib 122R longitudinally extends in the vertical direction. A protruding length of each rib 122R from the right side surface 120R is smaller than a protruding length of each protrusion 121R from the right side surface 120R. In other words, a right end face of each protrusion 121R is positioned right of a right end face of each rib 122R.

Further, each rib 122R has an inclined portion 122RA formed at an upper end portion thereof. The inclined portion 122RA extends downward and is inclined to be farther away from the right side surface 120R as going downward.

Figure 13A:
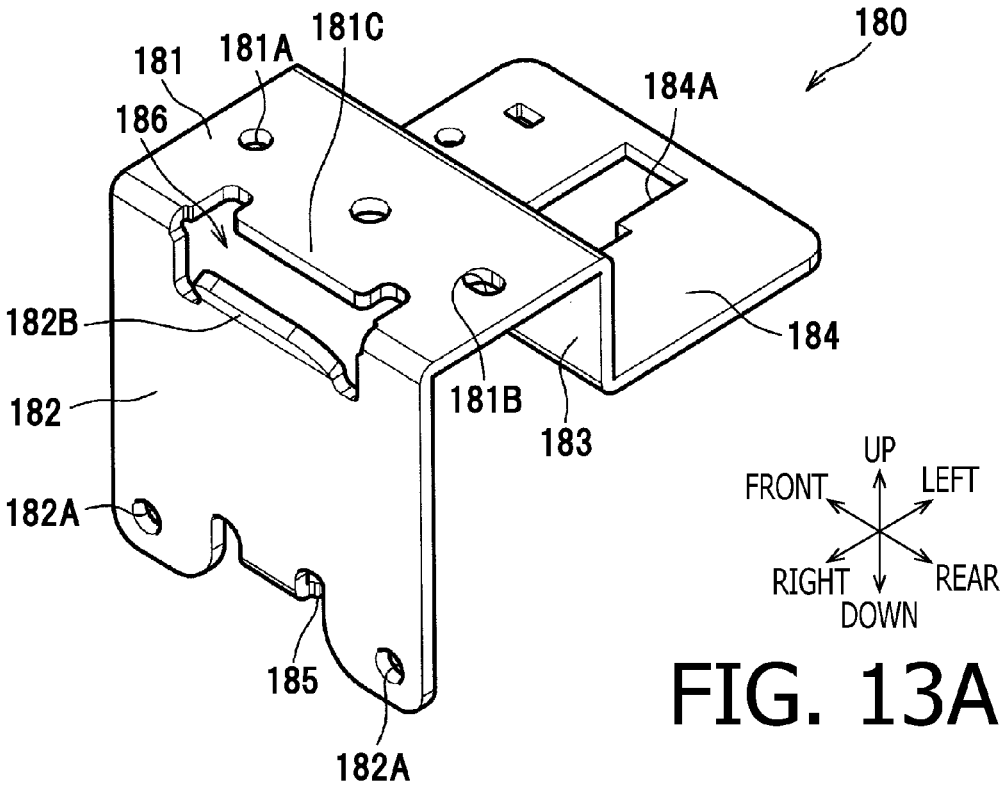
FIGS. 13A and 13B are perspective views showing the first bracket in the second illustrative embodiment according to one or more aspects of the present disclosure.
Figure 13B:
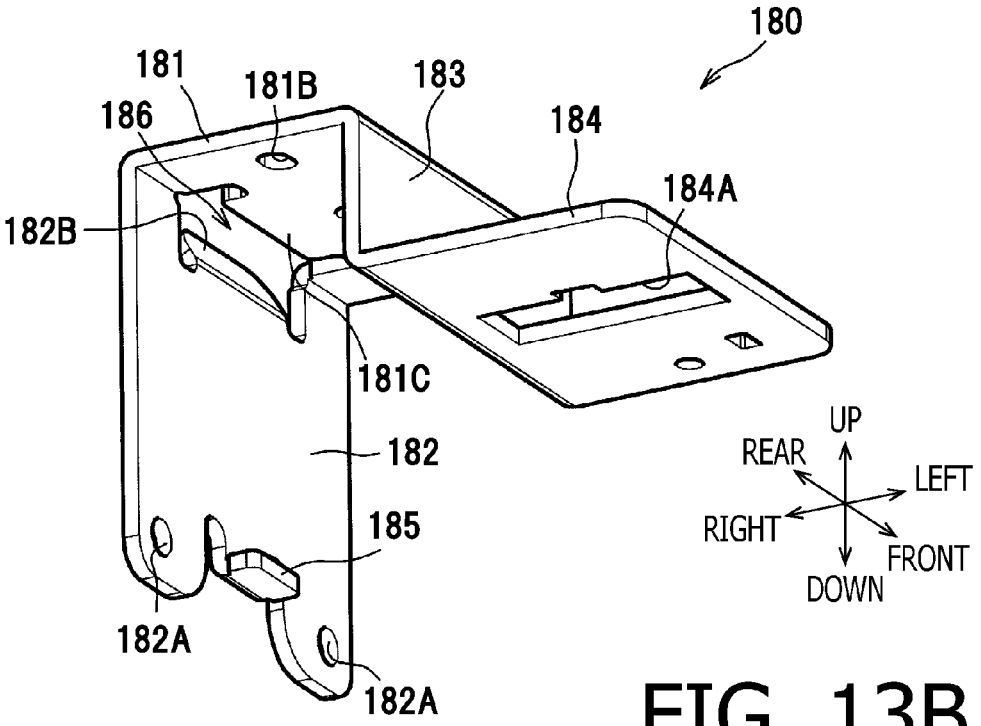

As shown in FIGS. 13A and 13B, the first bracket 180 is a plate-shaped metal member. The first bracket 180 includes a first cover portion 181, a second cover portion 182, a third cover portion 183, and a connector-attached portion 184. The first cover portion 181 extends horizontally. The second cover portion 182 extends downward from a right end portion of the first cover portion 181. The third cover portion 183 extends downward from a left end portion of the first cover portion 181. The connector-attached portion 184 extends leftward from a lower end portion of the third cover portion 183.

The first cover portion 181 has a round hole 181A and a long hole 181B. The long hole 181B is positioned behind the round hole 181A. The long hole 181B longitudinally extends in the front-to-rear direction.

The second cover portion 182 includes a first engagement portion 185 formed at a middle section, in the front-to-rear direction, of a lower end portion of the second cover portion 182. The first engagement portion 185 protrudes leftward, i.e., toward the first cover portion 181. Further, the second cover portion 182 includes two through-holes 182A formed in respective positions that are opposed to each other across the first engagement portion 185 in the front-to-rear direction.

The connector-attached portion 184 has an attachment hole 184A into which the main-body connector C1 is attached.

At a corner portion between the first cover portion 181 and the second cover portion 182, a first opening 186 is formed. The first opening 186 is formed in such a shape that a right end portion of the first cover portion 181 and an upper end portion of the second cover portion 182 are cut out.

There are a protecting portion 181C and a guide portion 182B formed in respective positions around the first opening 186. The protecting portion 181C is formed at an edge portion, facing the first opening 186, of the first cover portion 181 and protrudes toward the second cover portion 182 in the left-to-right direction. The guide portion 182B is formed at an edge portion, facing the first opening 186, of the second cover portion 182 and extends toward an outside of the first opening 186 (more specifically, obliquely toward an upper right side). In other words, the guide portion 182B extends in an obliquely upward direction to become farther away from the right side surface 120R of the first placement portion 101, from the edge portion, facing the first opening 186, of the second cover portion 182.

As shown in FIGS. 14A and 14B, the first bracket 180 configured as above is placed on the first placement portion 101 in such a manner that the first cover portion 181 covers the upper surface 110 of the first placement portion 101, that the second cover portion 182 covers the right side surface 120R, and that the third cover portion 183 covers the left side surface 130 of the first placement portion 101.

As the first bracket 180 is placed on the first placement portion 101, the first placement portion 101 is sandwiched between the second cover portion 182 and the third cover portion 183 of the first bracket 180.

The round hole 181A and the long hole 81B formed in the first cover portion 81 are engaged with the two first positioning projections 111 formed on the upper surface 110 of the first placement portion 101. Thereby, the first bracket 180 is positioned relative to the first placement portion 101 of the left side frame 100.

Then, when screws (not shown) are screwed into the left side frame 100 via the two through-holes 182A of the second cover portion 82, the first bracket 180 is fixedly attached to the left side frame 100.

As shown in FIG. 14B, the second cover portion 182 contacts the two protrusions 121R formed on the right side surface 120R of the first placement portion 101. Thereby, the second cover portion 182 is spaced apart from the right side surface 120R of the first placement portion 101. Thus, the first opening 186 of the first bracket 180 is positioned straight above a space between the second cover portion 182 and the right side surface 120R of the first placement portion 101.

The protecting portion 181C formed at the edge portion of the first opening 186 protrudes toward the center of the first opening 186 in the left-to-right direction, i.e., protrudes rightward (to the left of FIG. 5B) even relative to the right side surface 120R of the first placement portion 101. Thereby, it is possible to prevent a distal end portion of the insertion member 15 of the sheet discharge unit 10 from coming into contact with the left side frame 100 made of resin when the insertion member 15 is inserted into the first opening 186.

Further, a protruding length of the protecting portion 181C from an extension plane of the right side surface 120R is identical to the protruding length of each rib 122R from the right side surface 120R.

The main-body connector C1 is fitted into the attachment hole 184A of the connector-attached portion 184.

Figure 15:
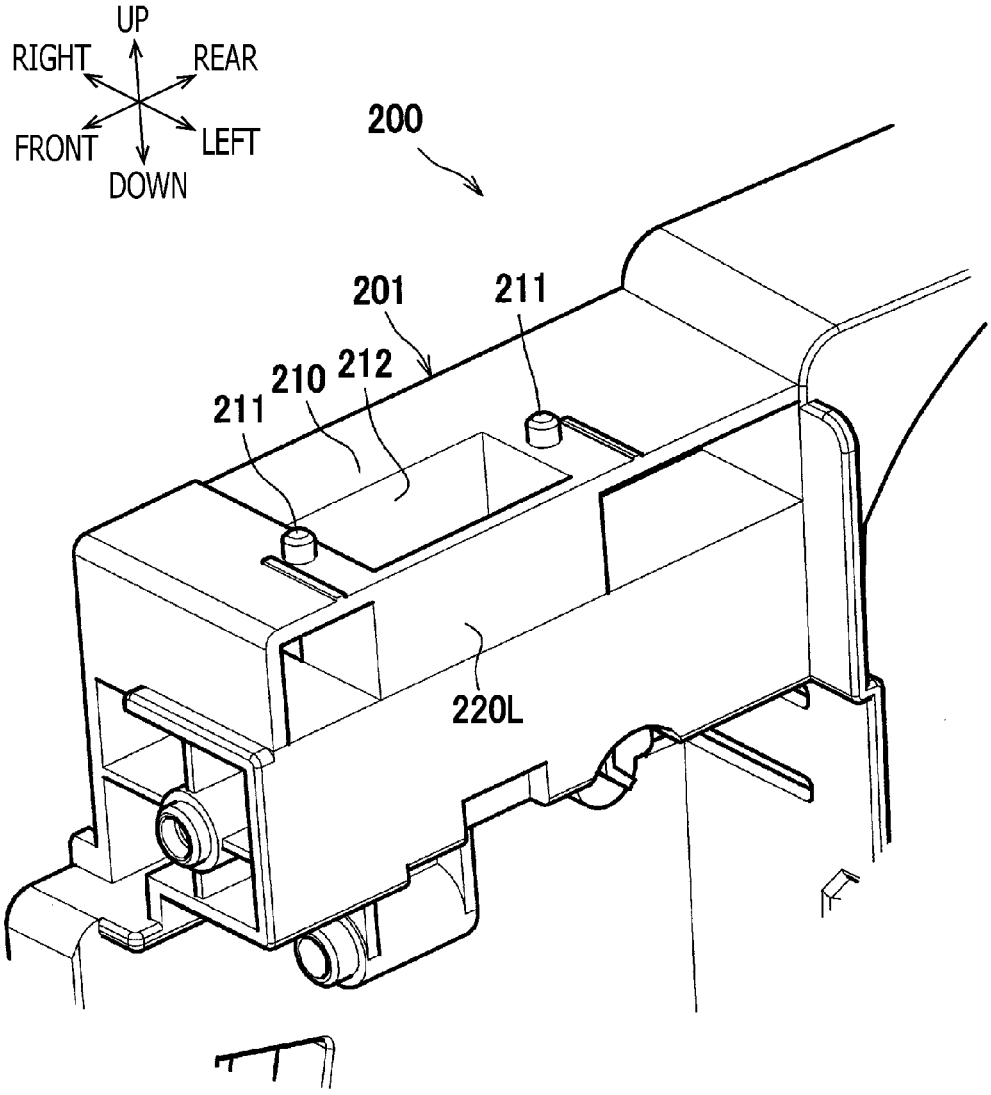
FIG. 15 is an enlarged perspective view showing a second placement portion at a rear end portion of a right side frame in the second illustrative embodiment according to one or more aspects of the present disclosure.

As shown in FIG. 15, the second placement portion 201 of the right side frame 200 includes an upper surface 210 and a left side surface 220L. The left side surface 220L extends downward from a left end portion of the upper surface 210.

The upper surface 210 of the second placement portion 201 is configured to receive a load from the sheet discharge unit 10 when the sheet discharge unit 10 is attached to the main body 2. On the upper surface 210, two second positioning projections 211 are formed. The two second positioning projections 211 protrude upward from respective positions spaced apart from each other in the front-to-rear direction.

Further, between the two second positioning projections 211, the second recessed portion 212 is formed to be recessed downward from the upper surface 210. In the same manner as the first recessed portion 112 formed at the left side frame 100, the second recessed portion 212 is formed to prevent generation of so-called "Sink Marks" on the upper surface 210.

Figure 16A:
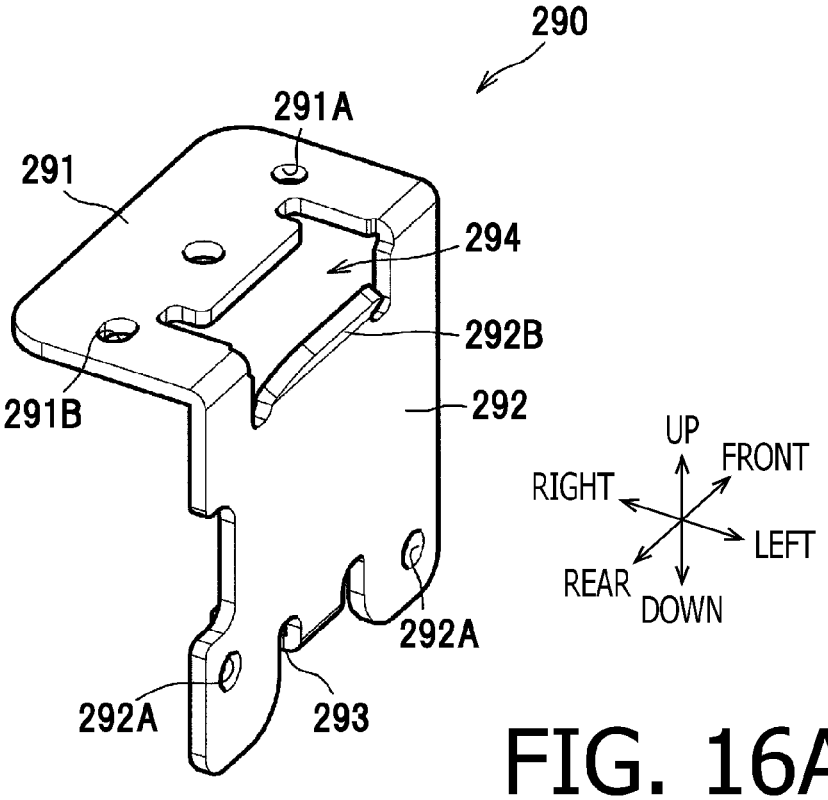
FIGS. 16A and 16B are perspective views showing the second bracket in the second illustrative embodiment according to one or more aspects of the present disclosure.
Figure 16B:
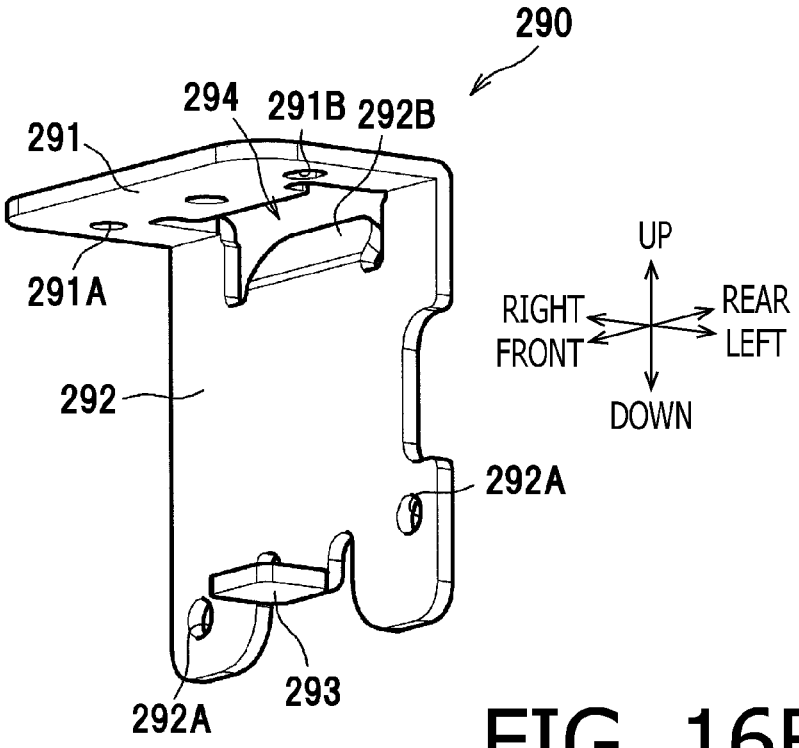

As shown in FIGS. 16A and 16B, the second bracket 290 is a plate-shaped metal member. The second bracket 290 includes a first cover portion 291 and a second cover portion 292. The first cover portion 291 extends horizontally. The second cover portion 292 extends downward from a left end portion of the first cover portion 291.

The first cover portion 291 has a round hole 291A and a long hole 291B. The long hole 291B is formed behind the round hole 291A. The long hole 291B longitudinally extends in the front-to-rear direction.

The second cover portion 292 includes a second engagement portion 293 formed at a middle section, in the front-to-rear direction, of a lower end portion of the second cover portion 292. The second engagement portion 293 protrudes rightward, i.e., toward the first cover portion 291. Further, the second cover portion 292 includes two through-holes 292A formed in respective positions that are opposed to each other across the second engagement portion 293 in the front-to-rear direction.

At a corner portion between the first cover portion 291 and the second cover portion 292, a second opening 294 is formed. The second opening 294 is formed in such a shape that a left end portion of the first cover portion 291 and an upper end portion of the second cover portion 292 are cut out. The second opening 294 is larger than the first opening 186 formed in the first bracket 180, in the left-to-right direction (i.e., the direction in which the two side frames 100 and 200 face each other).

There is a guide portion 292B formed at an edge portion, facing the second opening 294, of the second cover portion 292. The guide portion 292B extends toward an outside of the second opening 294 (more specifically, obliquely toward an upper left side). In other words, the guide portion 292B extends in an obliquely upward direction to become farther away from the left side surface 220L of the second placement portion 201, from the edge portion, facing the second opening 294, of the second cover portion 292.

Figure 17A:
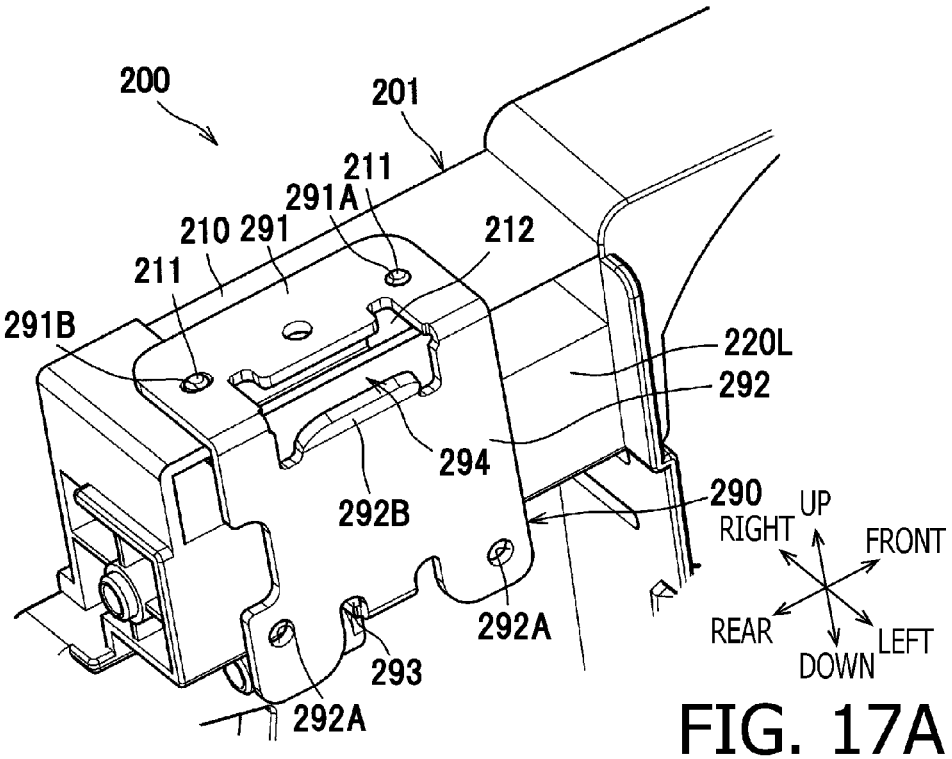
FIG. 17A is a perspective view showing the right side frame with the second bracket attached thereto in the second illustrative embodiment according to one or more aspects of the present disclosure.
Figure 17B:
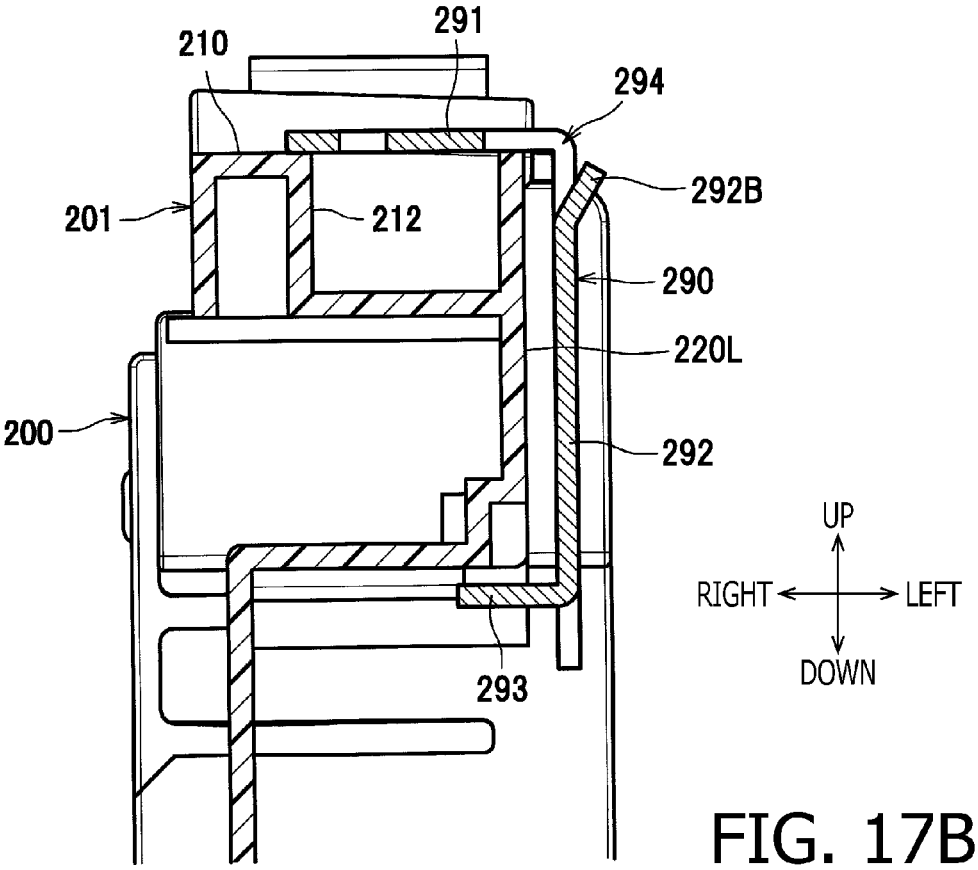
FIG. 17B is a cross-sectional rear view showing the right side frame with the second bracket attached thereto in the second illustrative embodiment according to one or more aspects of the present disclosure.

As shown in FIGS. 17A and 17B, the second bracket 290 configured as above is placed on the second placement portion 201 of the right side frame 200 in such a manner that the first cover portion 291 covers the upper surface 210 of the second placement portion 201 and that the second cover portion 292 covers the left side surface 220L of the second placement portion 201.

The round hole 291A and the long hole 291B of the second bracket 290 are engaged with the two second positioning projections 211 formed on the upper surface 210 of the second placement portion 201, respectively. Thereby, the second bracket 290 is positioned relative to the second placement portion 201 of the right side frame 200. Further, as screws (not shown) are screwed into the second placement portion 201 via the two through-holes 292A of the second cover portion 292, the second bracket 290 is fixedly attached to the second placement portion 201.

As shown in FIG. 17B, the second bracket 290 is fixedly attached to the second placement portion 201 in such a manner that the second cover portion 292 is spaced apart from the left side surface 220L of the second placement portion 201. Further, the second opening 294 of the second bracket 290 is positioned straight above a space between the second cover portion 292 and the left side surface 220L of the second placement portion 201.

In the same manner as exemplified in the aforementioned first illustrative embodiment with reference to FIG. 9, in the second illustrative embodiment as well, each insertion member 15 of the sheet discharge unit 10 is a plate-shaped metal member. Each insertion member 15 includes an attachment portion 151 and an insertion portion 152. The attachment portion 151 is configured to be fixedly attached to the housing 12 of the sheet discharge unit 10. The insertion portion 152 extends downward from the attachment portion 151.

Figure 18A:
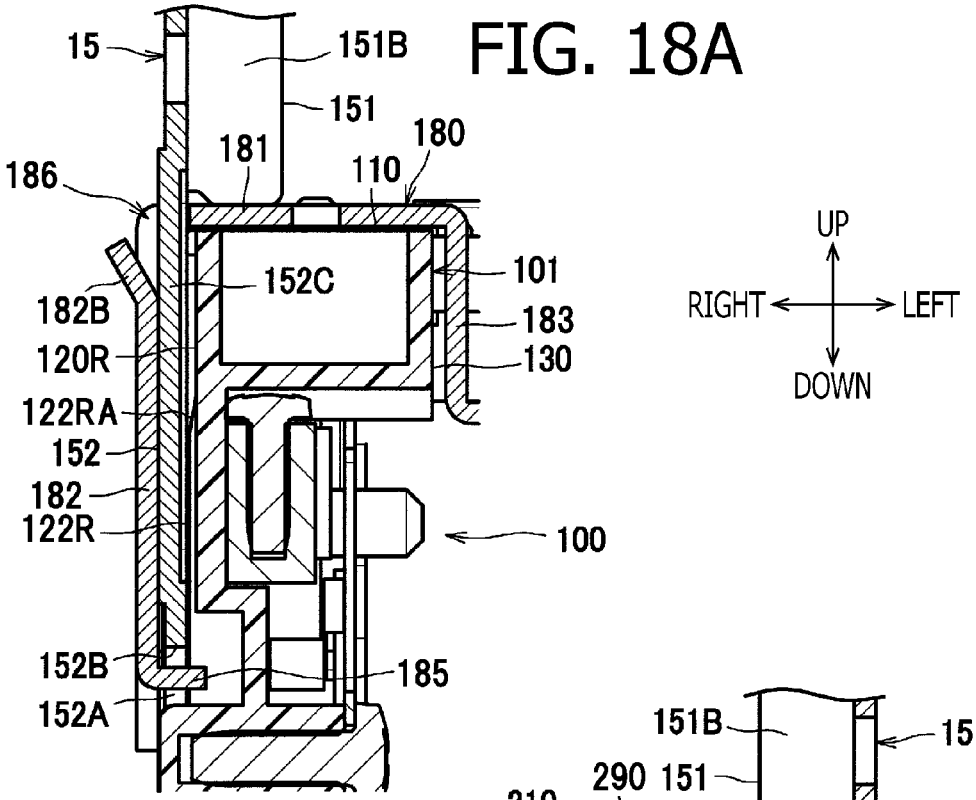
FIG. 18A is a cross-sectional rear view showing the left side frame and the first bracket with an insertion member inserted thereinto in the second illustrative embodiment according to one or more aspects of the present disclosure.
Figure 18B:
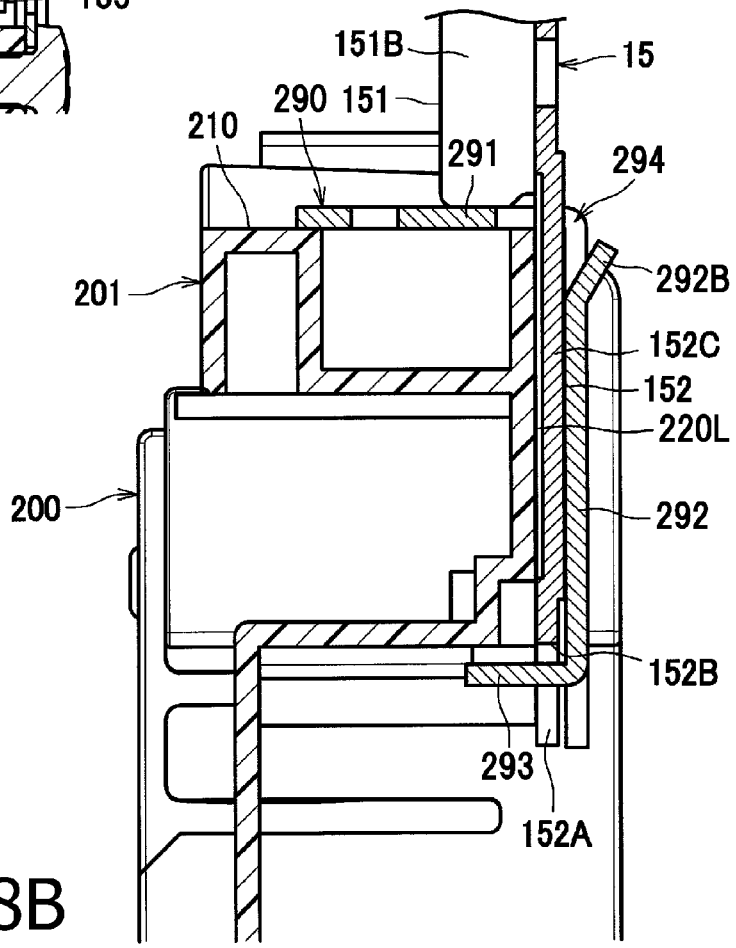
FIG. 18B is a cross-sectional rear view showing the right side frame and the second bracket with another insertion member inserted thereinto in the second illustrative embodiment according to one or more aspects of the present disclosure.

The attachment portion 151 is formed in such a rectangular U-shape that a front end portion and a rear end portion of the attachment portion 151 are bent inward in the left-to-right direction, in a vertical view (see FIGS. 9, 18A, and 18B). Specifically, the attachment portion 151 includes the main body section 151A and the contact sections 151B. The contact sections 151B extend inward in the left-to-right direction from a front end portion and a rear end portion of the main body section 151A, respectively.

The insertion portion 152 has a bifurcated distal end portion. Namely, the insertion portion 152 includes engagement protrusions 152A and an engagement recessed section 152B. Each engagement protrusion 152A protrudes downward. The engagement recessed section 152B is recessed upward at the central section of the distal end portion of the insertion portion 152 in the front-to-rear direction. Further, the insertion portion 152 includes a reinforcing portion 152C. The reinforcing portion 152C is formed in such a manner that a substantially central region of the insertion portion 152 is recessed inward in the left-to-right direction by drawing.

According to the insertion members 15 configured as above, as shown in FIGS. 18A and 18B, when the sheet discharge unit 10 is attached to the main body 2, the insertion portions 152 are inserted into the first opening 186 of the first bracket 180 and the second opening 294 of the second bracket 290, respectively. Further, the contact sections 151B of each attachment portion 151 (of the sheet discharge unit 10) are placed on a corresponding one of the first cover portion 181 of the first bracket 180 and the first cover portion 291 of the second bracket 290.

At the edge portion, facing the first opening 186, of the second cover portion 182, the guide portion 182B is formed. Further, at the edge portion, facing the second opening 294, of the second cover portion 292, the guide portion 292B is formed. By the guide portions 182B and 292B, the insertion portions 152 are guided to be inserted into the first opening 186 and the second opening 294, respectively. Thereby, it is possible to easily insert the insertion portions 152 into the first opening 186 and the second opening 294.

As shown in FIG. 18A, the inclined portion 122RA is formed at the upper end portion of each of the ribs 122R that protrude from the right side surface 120R of the first placement portion 101. The inclined portion 122RA is inclined to be closer to the second cover portion 182 as going downward to be farther away from the first opening 186. Therefore, it is possible to prevent the distal end portion of the insertion portion 152 inserted through the first opening 186 from being stuck on upper end portions of the ribs 122R.

Further, each rib 122R protrudes toward the second cover portion 182 from the right side surface 120R of the first placement portion 101. Nonetheless, each rib 122R extends in the vertical direction (i.e., the direction in which the insertion portion 152 is inserted). Therefore, the insertion portion 152 is allowed to be inserted without being stuck on the ribs 122R.

Then, the left insertion portion 152 inserted into the first opening 186 of the first bracket 180 is disposed between the second cover portion 182 of the first bracket 180 and the right side surface 120R of the first placement portion 101. Further, the insertion portion 152 is sandwiched between the second cover portion 182 and the two ribs 122R of the right side surface 120R. Specifically, the reinforcing portion 152C of the insertion portion 152 contacts the second cover portion 182. In addition, a part, other than the reinforcing portion 152C, of the insertion portion 152 contacts the two ribs 122R.

Further, the first engagement portion 185 of the first bracket 180 is inserted into the engagement recessed section 152B of the left insertion member 15. Then, the two engagement protrusions 152A engage with the first engagement portion 185 from the front and rear. Thereby, the left insertion member 15 is positioned relative to the first bracket 180 in the front-to-rear direction (i.e., a direction perpendicular to the direction in which the second cover portion 182 and the right side surface 120R of the first placement portion 101 face each other).

As shown in FIG. 19B, the right insertion portion 152 inserted into the second opening 294 of the second bracket 290 is disposed between the second cover portion 292 of the second bracket 290 and the left side surface 220L of the second placement portion 201. Further, the second engagement portion 293 of the second bracket 290 is inserted into the engagement recessed section 152B of the right insertion member 15. Then, the two engagement protrusions 152A engage with the second engagement portion 293 from the front and rear. Thereby, the right insertion member 15 is positioned relative to the second bracket 290 in the front-to-rear direction (i.e., a direction perpendicular to the direction in which the second cover portion 292 and the left side surface 220L of the second placement portion 201 face each other).

In the laser printer 1 configured as above in the second illustrative embodiment, the parts (i.e., the first bracket 180 and the second bracket 290) of the main body 2 that engage with the insertion members 15 of the sheet discharge unit 10 are made of metal that is a material having a higher stiffness than resin. Therefore, it is possible to enhance the strength of parts, to which the sheet discharge unit 10 is fixedly attached, of the main body 2 including the side frames 100 and 200 made of resin.

The contact sections 151B of the insertion members 15 of the sheet discharge unit 10 are placed on the first cover portion 181 of the first bracket 180 and the first cover portion 291 of the second bracket 290. Nonetheless, under the first cover portions 181 and 291, the upper surface 110 of the first placement portion 101 and the upper surface 210 of the second placement portion 201 are disposed. Therefore, it is possible to receive, by wide surfaces of the first and second placement portions 101 and 201, loads applied onto the first cover portions 181 and 291 via the insertion members 15.

Further, the second opening 294 of the second bracket 290 is larger in the left-to-right direction than the first opening 186 of the first bracket 180. Hence, it is possible to absorb positional and/or dimensional errors of the two insertion members 15.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein.

What is claimed is:

1. An image forming apparatus comprising:

an image forming unit;

a main body comprising:

a first discharge tray configured to receive a sheet conveyed out from the image forming unit; and a resin frame comprising a placement portion configured to support a sheet discharge unit placed thereon, the sheet discharge unit comprising:

a second discharge tray configured to receive a sheet conveyed out of the main body through the image forming unit; and an insertion member;

a metal bracket attached to the placement portion of the frame, the bracket having an opening into which the insertion member of the sheet discharge unit is inserted when the sheet discharge unit is attached to the main body.

2. The image forming apparatus according to claim 1, wherein the main body further comprises two resin frames including the frame and another frame, wherein the bracket comprises a first cover portion configured to cover respective upper surfaces of the two frames, at least part of the first cover portion overlapping the upper surfaces of the two frames in a vertical view; and wherein the bracket is attached to the two frames and configured to connect the two frames via the first cover portion.

3. The image forming apparatus according to claim 2, wherein the first cover portion has a through-hole extending in a direction in which the two frames face each other.

4. The image forming apparatus according to claim 2, wherein the bracket further comprises:

a second cover portion extending downward from the first cover portion, along a side surface of the frame of the two frames; and a third cover portion extending downward from the first cover portion, along a side surface of the another frame of the two frames.

5. The image forming apparatus according to claim 4, wherein the sheet discharge unit is placed on the at least part of the first cover portion that overlaps the upper surfaces of the two frames in the vertical view.

6. The image forming apparatus according to claim 4, wherein the first cover portion extends to an outside of the two frames in a direction in which the two frames face each other.

7. The image forming apparatus according to claim 4, wherein the second cover portion is attached to the side surface of the frame, and wherein the third cover portion is attached to the side surface of the another frame.

8. The image forming apparatus according to claim 2, further comprising a conveyance guide configured to connect the two frames and guide a sheet being conveyed in the main body, wherein the bracket is disposed to overlap the conveyance guide in a vertical view.

9. The image forming apparatus according to claim 8, further comprising:

a photoconductive body;

an exposure unit configured to expose the photoconductive body; and a supporting member configured to connect the two frames and support the exposure unit, the supporting member being disposed in a position displaced from the bracket in the vertical view.

10. The image forming apparatus according to claim 9, wherein the supporting member is disposed to overlap the conveyance guide in the vertical view.

11. The image forming apparatus according to claim 2, further comprising:

a circuit board supported by one of the two frames; and a metal cover member electrically grounded and configured to cover the circuit board, the cover member being electrically connected with the bracket.

12. The image forming apparatus according to claim 1, wherein the placement portion of the frame comprises:

a first surface configured to receive a load from the sheet discharge unit; and a second surface extending downward from the first surface, and wherein the bracket comprises:

a first cover portion configured to cover the first surface of the placement portion; and a second cover portion configured to cover the second surface of the placement portion.

13. The image forming apparatus according to claim 12, wherein the sheet discharge unit is placed on the first cover portion of the bracket.

14. The image forming apparatus according to claim 12, wherein the opening of the bracket is formed at a corner portion between the first cover portion and the second cover portion, wherein the second cover portion is spaced apart from the second surface, and wherein the insertion member inserted into the opening of the bracket is disposed between the second cover portion and the second surface.

15. The image forming apparatus according to claim 14, wherein the bracket further comprises a guide portion formed at an edge portion, facing the opening, of the second cover portion, and wherein the guide portion extends in an obliquely upward direction to become farther away from the second surface, from the edge portion, facing the opening, of the second cover portion.

16. The image forming apparatus according to claim 14, wherein the bracket further comprises a protecting portion formed at an edge portion of the first cover portion, the protecting portion protruding toward the second cover portion relative to the second surface of the placement portion.

17. The image forming apparatus according to claim 12, wherein the second surface of the placement portion comprises a rib that protrudes toward the second cover portion of the bracket from the second surface and extends in a direction in which the insertion member is inserted into the opening of the bracket.

18. The image forming apparatus according to claim 17, wherein the rib comprises an inclined portion formed at an end portion thereof close to the opening of the bracket, the inclined portion being inclined to be closer to the second cover portion as going farther away from the opening.

19. The image forming apparatus according to claim 17, wherein the bracket further comprises a protecting portion formed at an edge portion of the first cover portion, the protecting portion protruding toward the second cover portion relative to the second surface of the lacement portion; and wherein a protruding length of the rib from the second surface is identical to a protruding length of the protecting portion from an extension place of the second surface.

20. The image forming apparatus according to claim 12, wherein the bracket further comprises a bracket-side engagement portion, and wherein the insertion member comprises an insertion-member-side engagement portion configured to engage with the bracket-side engagement portion and position the insertion member in a direction perpendicular to a direction in which the second cover portion faces the second surface.

21. The image forming apparatus according to claim 12, wherein the bracket further comprises two bracket-side positioning portions, and wherein the placement portion of the frame further comprises:

two placement-portion-side positioning portions formed on the first surface, the two placement-portion-side positioning portions being configured to engage with the two bracket-side positioning portions, respectively, and position the bracket relative to the placement portion; and a recessed portion recessed from the first surface between the two placement-portion-side positioning portions.

22. The image forming apparatus according to claim 12, wherein the placement portion of the frame further comprises a third surface extending downward from an end portion of the first surface, the end portion of the first surface being opposite to an end portion from which the second surface extends downward, and wherein the bracket comprises a third cover portion configured to cover the third surface of the placement portion, the third cover portion and the second cover portion being disposed to sandwich the placement portion therebetween.

23. The image forming apparatus according to claim 1, wherein the main body further comprises two frames including the frame and another frame, each of the two frames comprising the placement portion, the bracket being separately attached to the placement portion of each individual one of the two frames, and wherein the opening of a second bracket of the two brackets is larger than the opening of a first bracket of the two brackets in a direction in which the two frames face each other.

24. The image forming apparatus according to claim 23, wherein the first bracket comprises a connector attachment portion to which a main-body-side connector is attached, the main-body-side connector being connected with a discharge-unit-side connector of the sheet discharge unit.

25. An image forming apparatus comprising:

an image forming unit;

a main body comprising:

a first discharge tray configured to receive a sheet conveyed out from the image forming unit; and a frame made of a first material comprising a placement portion configured to support a sheet discharge unit placed thereon, the sheet discharge unit comprising:

a second discharge tray configured to receive a sheet conveyed out of the main body through the image forming unit; and an insertion member;

a bracket attached to the placement portion of the frame, the bracket having an opening into which the insertion member is inserted when the sheet discharge unit is attached to the main body, the bracket being made of a second material having a higher stiffness than the first material of the frame.

* * * * *